US009033106B2

(12) United States Patent
Blinn

(10) Patent No.: US 9,033,106 B2
(45) Date of Patent: May 19, 2015

(54) SAFETY BARRIER NETTING SYSTEM

(76) Inventor: Lawrence Blinn, Upper Nyack, NY (US)

( * ) Notice: Subject to any disclaimer, the term of this patent is extended or adjusted under 35 U.S.C. 154(b) by 517 days.

(21) Appl. No.: 13/343,005

(22) Filed: Jan. 4, 2012

(65) Prior Publication Data

US 2013/0168626 A1 Jul. 4, 2013

(51) Int. Cl.
*E04G 21/32* (2006.01)

(52) U.S. Cl.
CPC ..... *E04G 21/3266* (2013.01)

(58) Field of Classification Search
USPC ..... 182/82, 87, 100, 137–139, 178.1, 182/178.5, 178.6
See application file for complete search history.

(56) References Cited

U.S. PATENT DOCUMENTS

| | | | | | |
|---|---|---|---|---|---|
| 3,480,069 | A | * | 11/1969 | Handwerker | 160/354 |
| 3,762,110 | A | * | 10/1973 | Boss, Jr. | 52/63 |
| 4,129,197 | A | | 12/1978 | Preston | |
| 4,803,819 | A | * | 2/1989 | Kelsey | 52/309.1 |
| 4,815,562 | A | | 3/1989 | Denny et al. | |
| 4,838,382 | A | | 6/1989 | Nusbaum | |
| 4,856,615 | A | | 8/1989 | Nusbaum | |
| 4,875,549 | A | | 10/1989 | Denny et al. | |
| 4,892,169 | A | | 1/1990 | Duncan | |
| 4,944,365 | A | | 7/1990 | Shalders | |
| 4,962,828 | A | | 10/1990 | Duncan | |
| 4,979,725 | A | | 12/1990 | Hutchings et al. | |
| 5,161,641 | A | * | 11/1992 | Nusbaum | 182/138 |
| 5,299,654 | A | | 4/1994 | Duncan | |
| 5,771,991 | A | * | 6/1998 | Fresco | 182/82 |
| 5,884,725 | A | * | 3/1999 | Reyland | 182/82 |
| 6,053,281 | A | | 4/2000 | Murray | |
| 6,223,494 | B1 | * | 5/2001 | Bright | 52/653.1 |
| 6,814,184 | B1 | * | 11/2004 | Blinn, Jr. | 182/178.1 |
| 7,191,907 | B2 | * | 3/2007 | Conway | 211/180 |
| 7,823,347 | B1 | * | 11/2010 | Blinn | 52/244 |
| 7,841,378 | B2 | * | 11/2010 | Henning | 160/327 |
| 7,896,132 | B2 | | 3/2011 | O'Gorman | |
| 8,511,039 | B2 | * | 8/2013 | Dougall et al. | 52/745.05 |
| 8,584,801 | B2 | * | 11/2013 | Baxter | 182/82 |
| 2007/0094942 | A1 | | 5/2007 | Dougall et al. | |
| 2009/0120718 | A1 | | 5/2009 | O'Gorman | |

* cited by examiner

*Primary Examiner* — Alvin Chin-Shue
*Assistant Examiner* — Colleen M Chavchavadze
(74) *Attorney, Agent, or Firm* — Osborne Law LLC

(57) ABSTRACT

A system for substantially enclosing the periphery of a building top with a netting system which is easily and efficiently movable or reconfigurable during the building construction process comprises a lightweight netting system for extending above a completed work area or floor, a strong lightweight structural support system for the netting, wherein the structural support system is vertically adjustable via slidable engagement with brackets attached to the floors which are already completed, provides enhanced safety for workers and for pedestrians below by preventing passage of workers or debris through the netting and enhances efficiency of construction by providing an easily reconfigurable, inexpensive and lightweight system for providing such enhanced safety.

22 Claims, 29 Drawing Sheets

SAFETY BARRIER NETTING SYSTEM

BACKGROUND

1. Field of the Invention

The present invention relates to the field of structural and building systems and structural components used in such systems, more particularly to strong, multi-purpose, lightweight and easily transportable structural and building systems and components for use in safety netting barrier systems, and in particular, to a perimeter safety netting system that is configurable to provide an easily movable and/or reconfigurable netting assembly atop, inter alia, buildings, and substantially surrounding the periphery thereof, during the building construction process.

2. Background and Description of Related Art

When engaged in dangerous construction situations and the like, the safety of those involved as well as pedestrians, bystanders or others in the vicinity may depend on maintaining a safety netting system adjacent the work area. In particular, natural forces such as bad weather, e.g., snow, ice, rain, wind, temperature, material conditions, material properties, worker competency, worker capability etc., have for many years caused accidents in the nature of falling debris which risks injury or damage to people and property in the vicinity of e.g., a high rise building construction site. A properly configured safety netting system adjacent and peripherally enclosing the work area in such construction projects significantly reduces the risk of injury or damage. Various safety netting systems for high-rise construction projects and the like have been provided in the past, but their implementation requirements and constraints and lack of ease of use or reconfiguration have been severe limitations in the effectiveness and efficiency of such systems. Specifically, a netting system that is substantially continuous around the periphery of the top of a building, is easily installed, is easily movable or reconfigurable during the construction process to keep pace with, and/or keep ahead of, the building construction, and is strong and lightweight, has not heretofore been available.

Various types of structural components and systems have been developed or used for safety barrier or netting systems. While typically strong, a common problem with structural systems and components for safety barrier systems is that they are heavy, difficult to handle, move or reconfigure and have a relatively high cost. For example, U.S. Pub. No. 2007/0094942 to Dougall et al. discloses a "Safety Barrier for Multi-Storey Buildings" which "has elongated safety barrier panels extending upwards from a first floor level a sufficient height to serve as effective safety barriers during the work for the subsequent floor. The panels are supported at their side edges in tracks along which the panels can slide. The tracks are duplexed (siamesed) so as to link the respective safety modules into a continuous peripheral barrier. The respective panels and tracks are braced and independently supported, permitting the system elements to be 'walked' piecemeal up the face of a structure as required during its erection." Abstract. However, while the Dougall et al. system described in the aforementioned application appears to provide a vertical perimeter barrier at the top of a building under construction, the description indicates that it does so in a very inefficient manner. The vertical panels used in the Dougall et al. system appear from the description to be very large and unwieldy rigid or semi-rigid structures which would appear to be extremely difficult to move or reconfigure as the building under construction progresses vertically as new floors are added. There is no teaching or suggestion in this application of providing easily movable netting support structures so that an entire netting system, including support structure, may be raised to the next highest position without the use of some involved or elaborate mechanism. The Dougall et al. system purports to use "tracks" in which the barrier panels can slide, and thus the barrier panels do not move up the building as an integral unit with the support structure. In fact, "the secured fence panel 24 serves as a guide for the upward sliding of the side tracks 26, as they are hoisted or winched to their new station at the next level." ¶ 0034. Thus the barrier panels are not fixedly attached to the vertical support structural members. Rather, the vertical support members and barrier panels are separate components which are engaged via slider tracks. The Dougall et al. system thus appears to involve a quite intricate vertical support structure which is guided by the barrier panels themselves, which panels therefore must be extremely rigid, and thus heavy or requiring a substantial amount of material, to perform the guiding function. However, a desirable aspect of a peripheral netting system would remove such requirement for extensive structure rigidly attached to or incorporated into a barrier panel. Ideally, all or a substantial part of the vertical support structure in such a netting system would be slidably engaged with small footprint building mounting brackets so as to minimize the amount of structure required which would appreciably reduce the overall weight of the system. The Dougall et al. system fails to provide such an efficient system because it requires "dual" (i.e., corresponding) slidably engaging rigid members as opposed to a single rigid member which supports the barrier net (on one side of the net) at all times and which is slidably engaged with a small footprint bracket which is rigidly attached to a construction floor slab. The Dougall et al. system is thus too heavy, expensive and cumbersome to satisfy the need for a safety netting or barrier system for optimal use in high-rise building construction projects.

A further example of a heavy, cumbersome system for providing a safety barrier system for high rise construction is the one provided by United Building Supply Company ("UBS") of New Rochelle, N.Y. offers a "cocoon" system for purported use atop high-rise buildings during construction to prevent debris from falling. See http://www.ubs1.com/protection-systems.html. However, the UBS system is heavy, difficult to handle and is not easily reconfigurable or movable during construction. The UBS system incorporates barrier panel support members which are engaged with vertical support members which appear to be rigidly attached to the building structure, thus requiring a substantial amount of support member structural material. In contrast, the system described and claimed herein operates by, inter alia, eliminating longitudinally (i.e., vertically) interfacing structural net support members which significantly reduces the amount of material required, and hence the cost is reduced and the system described and claimed herein is as a result much easier to handle and reconfigure during the building construction process.

The UBS system is purported to be a "cocoon protection system" which is "designed to protect the leading edge of floors under construction." See http://www.ubs1.com/protection-systems.html. The UBS protection system purportedly "[c]onsist[s] of vertical panels, solid horizontal flaps, and a secondary safety net, the system is designed to provide fall protection and debris containment at the source. Connecting to the top two most recently constructed floors, the system extends approximately two and a half additional floors, providing protection at the perimeter of both the top and next to be constructed floors. A series of interlocking panels and slider rails, custom designed and fabricated to the building specifications, allow the system to be raised in sequence with construction operations. Handrails are located at each floor elevation, solid decks are provided for access and debris containment at the lower two floors, and a material net with fine debris liner is installed below the system to provide further containment of any small debris." Id. While the UBS system described in the aforementioned document appears to provide a vertical perimeter barrier at the top of a building under construction, the description indicates that it does so in a very inefficient manner. The vertical panels used in the UBS system appear from the description to be very large and unwieldy rigid or semi-rigid structures which would appear to be extremely difficult to move or reconfigure as the building under construction progresses vertically as new floors are added. There is no teaching or suggestion in this UBS literature of providing easily movable netting support structures so that an entire netting system, including support structure, may be raised to the next highest position without the use of some involved or elaborate mechanism. While the UBS system purports to use "slider rails," those rails appear to engage with a stationary vertical support structure. The UBS system thus appears to involve a quite intricate vertical support structure which is rigidly attached to a building under construction and requires a very large amount of material. A desirable aspect of a peripheral netting system would remove such requirement for extensive structure rigidly attached to the building. Ideally, all or a substantial part of the vertical support structure in such a netting system would be slidably engaged with small footprint building mounting brackets so as to minimize the amount of structure required which would appreciably reduce the overall weight of the system. The UBS system fails to provide such an efficient system because it requires "dual" (i.e., corresponding) slidably engaging rigid members as opposed to a single rigid member which supports the barrier net at all times and which is slidably engaged with a small footprint bracket which is rigidly attached to a construction floor slab, and thus has this same drawback as the Dougall et al. system discussed above. The UBS website states that the UBS "cocoon" system is patented. However, no such patent or application was located in a search of USPTO or Google Patents databases.

As to the safety aspect with respect to the UBS system, to the extent the panels must be detached for a move or reconfiguration, the precise situation which it is desired to avoid is created, i.e., large structural members are in danger of being dropped to the ground when a large panel is detached for reconfiguration. A barrier netting or protection system which is not detached from the building under construction during moves of the barrier net system would never present the repeating unsafe condition of the UBS system. Regarding efficiency, much more labor and equipment is required for the UBS system than a system which is reconfigurable without detachment from the building under construction. The UBS system essentially requires its own extensive construction project, time after time, as a building progresses upward. A system which is easily movable or reconfigurable as an integral unit with minimal manual labor and equipment, preferably without a crane, and which does not require detachment from the building under construction, and which incorporates a single vertically reconfigurable lightweight, strong, barrier support member is needed by the high-rise construction industry. However, to date, no such system has been provided.

Other prior systems that are directed to debris barriers for high rise construction are lighter weight than the UBS system, but they are disadvantageous in other critical ways. For example, U.S. Pat. No. 4,815,562 to Denny et al. discloses a debris barrier which is rigidly attached to a building structure and uses a meshed netting structure. The barrier of Denny et al. is comprised of a woven flexible mesh netting having a cord longitudinally extending along the top of the netting to form a reinforced border. The top of the netting is clipped to a safety cable so as to vertically suspend a portion of the netting. See, e.g., Abstract. However, there is no teaching in Denny of any adjustability of the netting during the construction process. Nor is there any teaching of a vertical netting system which substantially encloses the periphery of the top of a building under construction. Nor is there any teaching in Denny of a structural support system which itself is vertically adjustable via brackets attached to the floors which are already completed. Nor does Denny et al. describe a system for enclosing the periphery of a building top with a netting system which is easily and efficiently movable or reconfigurable during the building construction process. Nor is there any teaching in Denny et al. of providing a netting system for extending above a completed work area or floor.

U.S. Pat. No. 4,856,615 to Nussbaum discloses a safety netting system which used fixedly mounted guide rails to allow a net to be raised and lowered. Guide rails are provided which are rigidly attached to a building structure and provide a continuous track along which the safety net may be raised or lowered. Col. 5, lines 59-66. However, there is no teaching in Nussbaum of providing a netting system for extending above a completed work area or floor. Nor is there any teaching in this patent of a structural support system which itself is vertically adjustable via brackets attached to the floors which are already completed. Nor is there any teaching in this patent of a vertical netting system which substantially encloses the periphery of a building top.

SUMMARY

The safety netting barrier system described herein is formed by integration of substantially vertical structural support members with an attachment mechanism to connect the support members to, e.g., a building under construction, and a netting mesh structure which is supported by the vertical structural support members.

An object of the invention is to address the above-described deficiencies of the related art by providing a structural member and accessory components to create versatile, lightweight, strong, relatively inexpensive, easily assembled, easily transportable, easily reconfigurable and easily adjustable structures for providing a safety netting barrier system.

An object of the invention is to provide a safety barrier system capable of extending from the proximity of the edge of one floor, deck or slab of a building structure and projecting upwardly above the level of the edge of a superimposed higher floor, deck or slab of the structure by an amount sufficient to constitute an effective safety barrier for workers located at said higher level and to provide a barrier to prevent debris from falling from the higher or adjacent levels, wherein said safety barrier net is fixedly attached to at least two vertical support members, each said vertical support member being slidably engaged with a bracket structure and wherein said bracket structure is fixedly attached to a component of said building structure, and wherein said superimposed higher floor, deck or slab is either a future floor, deck or slab to be constructed or is incomplete.

An object of the invention is to provide a safety barrier system wherein the height between one floor of a building under construction or maintenance and a superimposed floor, deck or slab one floor higher has a predetermined value, said vertical support members are extendable to or beyond said predetermined height of the superimposed floor, deck or slab and said vertical support members are capable of being extended upwardly a sufficient distance to enable said safety barrier net to be elevated, in positioned relation between the vertical support members, and extending above said superimposed floor, deck or slab to constitute an effective safety barrier above, below and at the level of said superimposed floor, deck or slab.

The present invention relates to a structural member and structural systems using the structural member in concert with other components to provide a safety netting system. The structural member, in one embodiment, comprises a tube having external longitudinal, radially projecting flanges that are regularly angularly spaced about the circumference of the tube. The tube may have a cross-section in the shape of a circle, square, hexagon, octagon, or any other regular polygonal shape. Typically, the structural member is extruded from aluminum, but may be manufactured from any of a variety of materials (including non-metals), and may be fabricated by methods other than by extrusion. In instances where parts of structural systems utilizing the structural member are exposed to damage or exceedingly high loads, stronger materials, such as steel, may be used.

Alone, the aforesaid flanged tube structural member embodiment of the invention benefits from a cross-section that supports very high resistance to applied loads in all dimensions under a variety of loading conditions (compression, tension, shear, torsion, combined loading, etc.). When used in combination with other components, which will be described in more detail below and in the appended drawings, a variety of strong and versatile netting system structures can be created quickly, efficiently and inexpensively.

Due to the relatively high strength, stability and subsequent ability for weight reduction afforded by the shape of the flanged tube embodiment of the structural member of the invention, using it as the backbone structure in a netting application for high-rise construction and the like is advantageous. Also, due primarily to the light weight and "modular" nature of the flanged tube structural member, the structural netting systems using the structural member may be implemented in locations not easily accessible by conventional technologies. For example, with the flanged tube structural member and associated structural systems, the largest and heaviest component is usually the structural member itself. Since such flanged tube structural members are typically, in size, about 10 feet in length (though they may be longer or shorter), and since they are typically manufactured from aluminum, they may be carried by individual workpeople, without the need for cranes, hoists or other lifting devices. Moreover, since the size of the flanged tube structural member is relatively manageable, as are the other components of the structural netting systems described and claimed herein, they may be brought into and assembled within confined quarters or low-accessibility locations where bringing in a larger component, a pre-assembled structure or partially assembled components would be impossible or highly difficult. The tops of high rise structures under construction where the described and claimed safety netting system may be used are examples of such locations.

The benefits to the aforementioned flanged tube structural member and structural netting systems using such a flanged tube structural member should become apparent to those knowledgeable in the art, in light of the below detailed description, claims, and drawings.

The foregoing summary includes example embodiments of the system, method and articles that are not intended to be limiting. The above embodiments are used merely to explain selected aspects or steps that may be utilized in implementations of the present disclosure. However, it is readily apparent that one or more aspects, or steps, pertaining to an example embodiment can be combined with one or more aspects, or steps, of other embodiments to create new embodiments still within the scope of the present disclosure. Therefore, persons of ordinary skill in the art would appreciate that various embodiments of the present disclosure may incorporate aspects from other embodiments, or may be implemented in combination with other embodiments.

DESCRIPTION OF DRAWINGS

The description of the various example embodiments is explained in conjunction with appended drawings, in which.

DETAILED DESCRIPTION OF EXEMPLARY EMBODIMENTS

Figure 1:
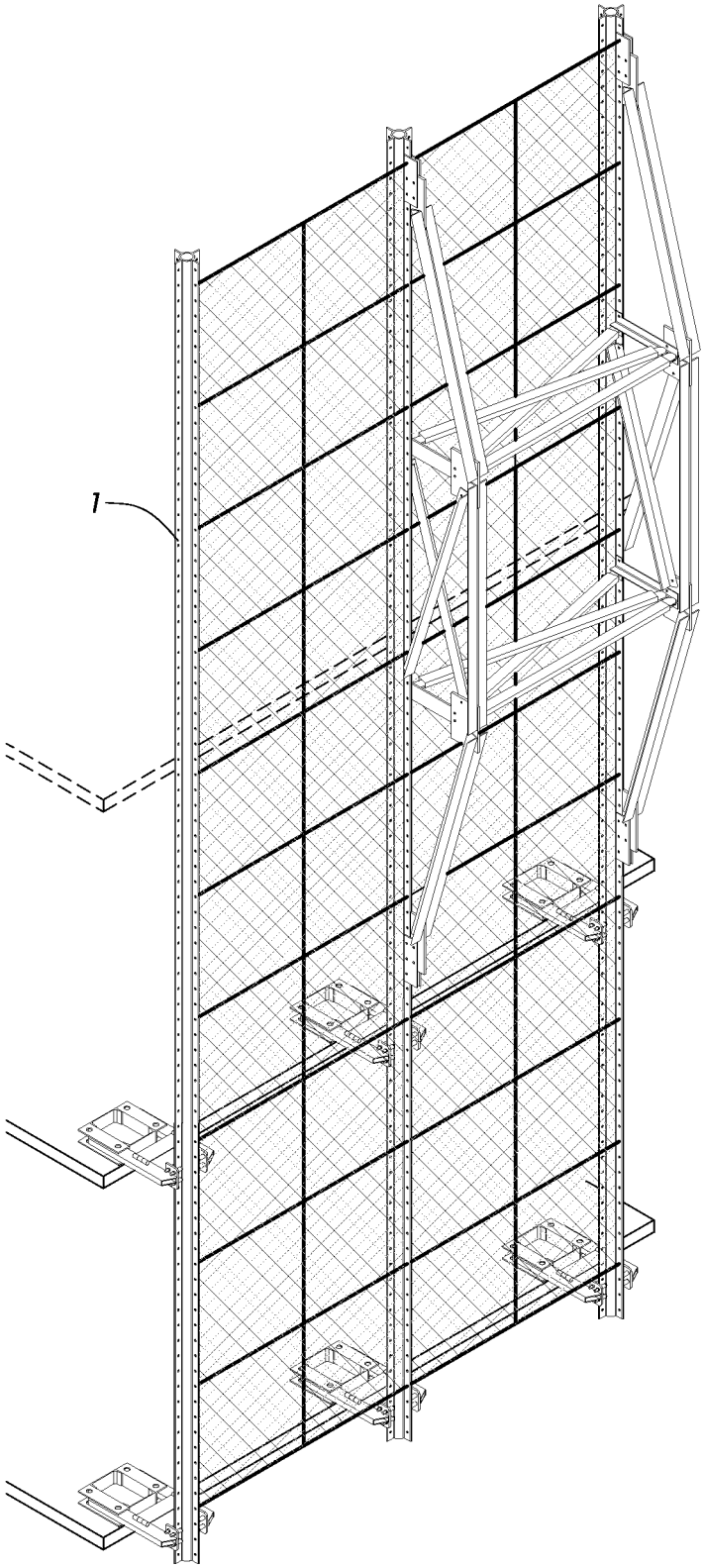
FIG. 1 shows a safety netting system falling within the scope of the present disclosure

The safety netting barrier system described herein is formed by integration of substantially vertical structural support members with an attachment mechanism to connect the support members to, e.g., a building under construction, and a netting mesh structure which is supported by the support members. Such a safety netting system falling within the scope of the present disclosure is shown in FIG. 1.

The safety netting barrier system described herein is typically designed and engineered to be used 10 to 25 ft. above the top floor of a building under construction. In one embodiment, the total height of the safety netting system can be between 25 to 100 ft. The system can enclose the top 2 to 15 floors of a building under construction and free stand 10 to 25 ft. above the top floor under construction from where it is attached.

The safety netting barrier system described herein may be manually or mechanically lifted or reconfigured with minimal human contribution. In the case of manual lifting or reconfiguration, one person can perform the task alone. The safety netting system described herein may be installed and dismantled with or without a crane.

A safety barrier system encompassed by the invention is capable of extending from the proximity of the edge of one floor or slab of a building structure to project upwardly above the level of the edge of a superimposed higher floor or slab of the structure by an amount sufficient to constitute an effective safety barrier for workers located at said higher level and to provide a barrier to prevent debris from falling from the higher or adjacent levels.

A safety barrier system encompassed by the invention may comprise a safety barrier net which is fixedly attached to at least two vertical support members, wherein each vertical support member is slidably engaged with a bracket structure and wherein the bracket structure is rigidly, albeit temporarily, attached to a component of said building structure at or proximal to a floor slab or other component of the building structure which has been substantially completed (at least from the perspective of pouring of a slab or placing the floor structure or fixing another structural component to which the bracket structure is affixed), and wherein said superimposed higher floor or slab is either a future floor or slab to be constructed or is incomplete.

A safety barrier system encompassed by the invention may be used to provide a safety barrier system wherein the height between one floor of a building under construction or maintenance and a superimposed floor or slab one floor higher has a predetermined value, wherein vertical support members are extendable to at least the predetermined height of the superimposed floor or slab, wherein the safety barrier net has a third predetermined height, wherein the second predetermined height exceeds the first predetermined height by substantially at least the third predetermined height, whereby in use, the vertical support member secured to one floor or slab or other component of the building structure via said bracket, said vertical support member extends upwardly a sufficient distance to enable the safety barrier net to be elevated, in positioned relation between the vertical support member, and extending to its third height above the superimposed floor or slab, to constitute an effective safety barrier above, below and at the level of the superimposed floor or slab.

A flanged tube "star leg" type structural support member is advantageously used in one embodiment of the netting system disclosed herein. The star leg is a pipe or tube having four radially projecting flanges spaced at 90 degrees apart around the tube and which run the length or substantially the length of the tube. The star leg is preferably extruded aluminum, or other strong and lightweight material, circular tube which may be between 4 and 5 inches in outside diameter and may be ½ inch thick, and having 4 equally spaced ½ inch thick three inch longitudinal fins projecting from the tube. The fins have holes placed 6 inches on center to support the vertical net. When raised, the legs are 8 to 10 feet long and spliced together to form lengths from 20 feet to 120 feet long. Their un-spliced length allows them to be brought up to the construction floor via a construction hoist. In addition to the following discussion of the attributes and advantages of the star leg structural support member as applied to the presently described and claimed structural safety netting or barrier system, the description of U.S. Pat. No. 7,823,347 is hereby incorporated by reference.

Figure 2A:
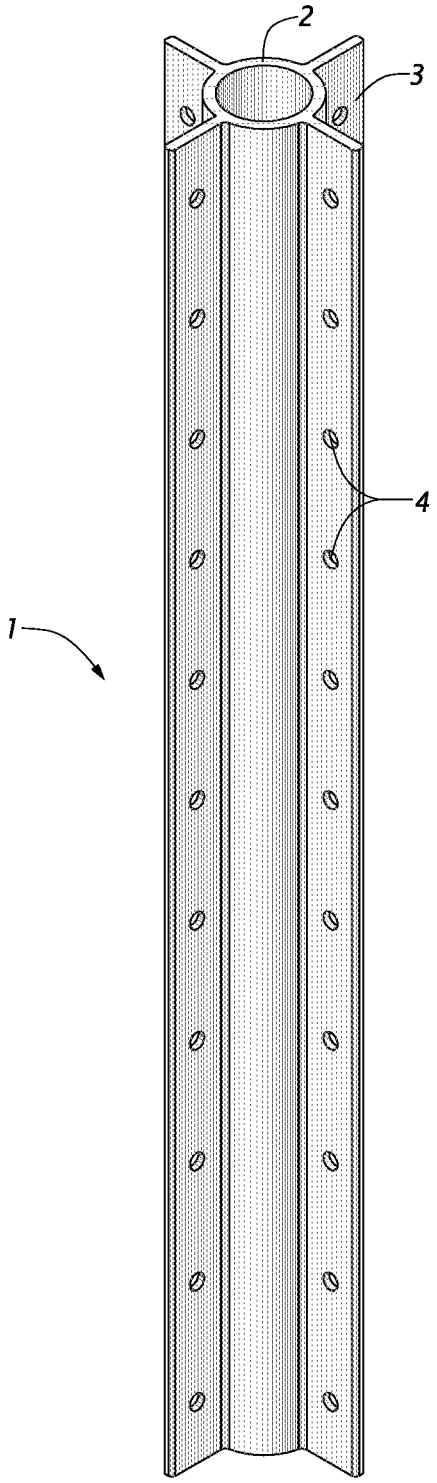
FIG. 2A shows an isometric view of a flanged tube structural member used in a preferred embodiment of the netting structure system described herein.

A structural member 1 according to the star leg embodiment of the invention is shown in the context of a barrier netting system in FIG. 1 and individually in isometric view in FIG. 2A. The structural member 1, in a preferred embodiment, comprises an extruded hollow tube 2 with four equally-spaced exterior radially-projecting flanges 3. The flanges have regularly spaced holes 4 which facilitates easy attachment of other members 1 at many vertical locations. The holes 4 also may facilitate attachment of a barrier net structure or other structural members, e.g., lateral supports, to the structural members 1 in a safety barrier system. Such structural members 1 can extend to lengths of over 25 feet each, although lengths of approximately 10 feet are typical. This range of length is ideal for the safety netting support structure of the safety netting or barrier system described and claimed herein. Structural members 1 may be used as the prime vertical and horizontal supports in the structures in which they are used. In the presently disclosed netting system, the structural members 1 serve primarily as movable vertical support members for the netting mesh structure, wherein the vertical members may be raised while maintaining sliding engagement with fixed floor slab mounted brackets. The structural members 1 are typically arranged such that flanges 3 extend from the tube 2 of each structural member 1 and are directed toward opposing vertical support members 1 within the netting structural system ("interior flanges"), while the other two are directed either away from or toward the building or structure to which the structural members are attached ("exterior flanges").

Figure 2B:
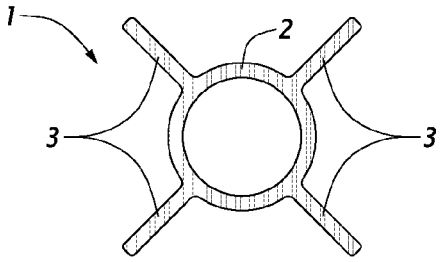
FIG. 2B shows a sectional view of a structural member used in a preferred embodiment.
Figure 2C:
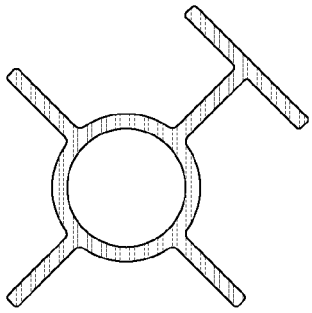
FIG. 2C shows a sectional view of a structural member used in a preferred embodiment.
Figure 2D:
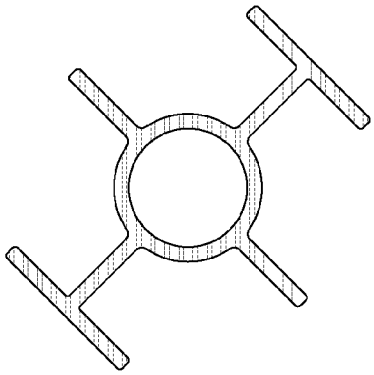
FIG. 2D shows a sectional view of a structural member used in a preferred embodiment.
Figure 2E:
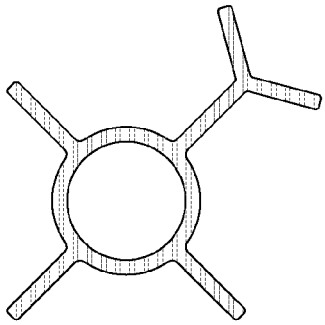
FIG. 2E shows a sectional view of a structural member used in a preferred embodiment.
Figure 2F:
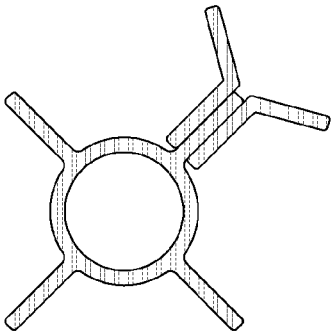
FIG. 2F shows a sectional view of a structural member used in a preferred embodiment.

A cross section of a structural member 1 of one embodiment of the invention is shown in FIG. 2B. Structural members 1 can be extruded from a variety of aluminum alloys for strength and light weight. Other materials may provide these attributes as well, e.g., titanium alloys, magnesium alloys, beryllium alloys, metallic or non-metallic composite materials or lightweight steel alloys. For most applications, inner diameters are between 3 and 6 inches and wall thicknesses are between 0.3 and 0.8 inches. Flanges 3 extend radially from the outer diameter of the tube for lengths typically between 2 and 4 inches, and may be formed during the extrusion process by use of an appropriate die. Of course, the flanges 3 can be manufactured separately and thereafter attached to the vertical structural member 1 by known means, such as by welding, riveting, or bolting. Although FIG. 2B shows an embodiment with a tube 2 having a circular cross-section, the invention is not limited to use of structural members of only circular cross-section. For example, by way of illustration, the cross section may be a circle as described in the instant embodiment or it may be, e.g., square, hexagon, octagon, or any other regular polygonal shape, or it may be an irregular cross-section or composite of regular polygonal shapes in particular implementations.

By adding radial flanges 3 to the tubular portion 2, the vertical structural member of the invention provides advantages in several ways. First, the flanges 3 increase the area moment of inertia about the neutral axis of the member, thus reducing the bending and torsional stresses that develop in the structural member 1. Of course, lower stresses translate into enhanced load bearing capability and greater allowable unbraced lengths. Radially-projecting, substantially rectangular flanges 3 are but one embodiment of the vertical structural member of the invention. Radially-projecting "T" members or other members of various cross sections which increase the area moment of inertia also fall within the scope of the invention so long as such flange cross sections will work in the overall context of the vertical support member used to support a net or barrier and being slidably engaged with a floor slab mounted bracket.

A second advantage to the star leg structural member design is that it avoids an exceedingly "weak" axis. The distribution of the four radial flanges 3 from the circular cross-section provides equivalent load-bearing capability in each of these four directions, as well as in diagonal directions. Consequently, the structural members 1 do not have to be oriented about their own axes in any particular way to achieve the desired strength. This is in distinction to other common structural member cross sections such as angles, channels and I-beams which require special attention to axial orientation to avoid applying the highest operational loads to weak axes. However, other stiffening aspects, members, structures or webs may be included in concert with the flanged tube cross section to enhance stiffness of the structural members 1. Exemplary cross sections of such members providing enhanced stiffness are shown in FIGS. 2C thru 2F. However, any cross section could be used so long as the described and claimed aspects of the invention are incorporated into a barrier netting system.

A third benefit of the instant structural member design is the plurality of regularly spaced holes 4 in each of the flanges 3. These holes 4 in the flanges 3 that run the length of the structural members 1 provide a ready availability of structural connection points. Structural connections can be made at either interior or exterior flanges 3. One benefit of this feature is enhanced flexibility in accommodating the netting system to the particular requirements of a specific project site. Additional detail regarding the preferred tubular structural member with radially projecting flanges is provided in U.S. Pat. Nos. 6,814,184 and 7,823,347.

The invention encompasses various fastening mechanisms for structurally joining the various members (e.g., columns, girts, and braces) used to configure the netting support structure assembly. FIGS. 3A-D illustrate various views of connection adapters 5, 7, 9. These structural connection members 5, 7, 9 may be used to structurally join two structural members 1 vertically one above the other in particular embodiments, although these particular connection members are not required, and any such use of such connection members must be configured in such manner as to avoid interference with the slidable engagement of the vertical member 1 with floor mounting brackets. The connection adapters 5, 7, 9 shown in FIGS. 3A-D also allow for girts and braces to be attached at this location. Although not required for the described and claimed netting system, girts and braces may be incorporated in the structural support system to increase rigidity, to maintain overall structural shape, to compensate for missing floor bracket support members or any other reason a person of skill in the art might deem such members necessary or advisable. The above and below-described structural components, in combination with girts and braces (collectively "bracing members") may be used to construct the structural systems which support the mesh netting structure.

The star tube column members discussed above may be used in the debris and safety netting system described herein during the construction of, e.g., concrete floors and to provide worker safety for the floor under construction and two floors directly below. In an embodiment using such star tube column members, the framing is mainly composed of the star tube column members having holes on the exterior facing fin for wire rope and net support. For in-plane lateral stability of the column, girt and x-bracing may be used above the uppermost tie level. Also, the leg is stiffened when required (in out of plane) with a stay truss system to increase the workable cantilever past the last tie level.

Depending on the application, bracing members may have any of a variety of cross-sections. For example, girts and braces may have a solid rectangular cross-section, though other shapes are possible. With such a rectangular cross-section, standard sizes of flat stock may be used. In other embodiments, the girts and braces may utilize a tubular cross-section (typically square in shape), though bars and tubes having cross-sections of other shapes are also possible. Depending on the application (orientation, loads, etc.) and/or desired aesthetics of the completed structural assembly, the girt and brace shapes may be pre-selected accordingly.

Figure 4A:
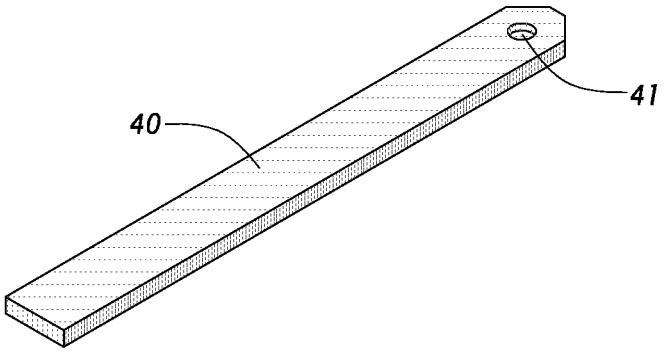
FIGS. 4A-4D illustrate exemplary mounting ends for bracing members used in the subject structural systems of the subject safety netting system.

A basic mounting end for the bracing members, as shown in FIG. 4A, includes a hole 41 in one end of the bracing member 40 to accept a connecting bolt, enabling attachment to other pieces of the structural system. In an alternate embodiment, such a mounting end may involve a second piece attached to the bracing member itself, this piece having a hole therein to allow attachment.

Figure 4D:
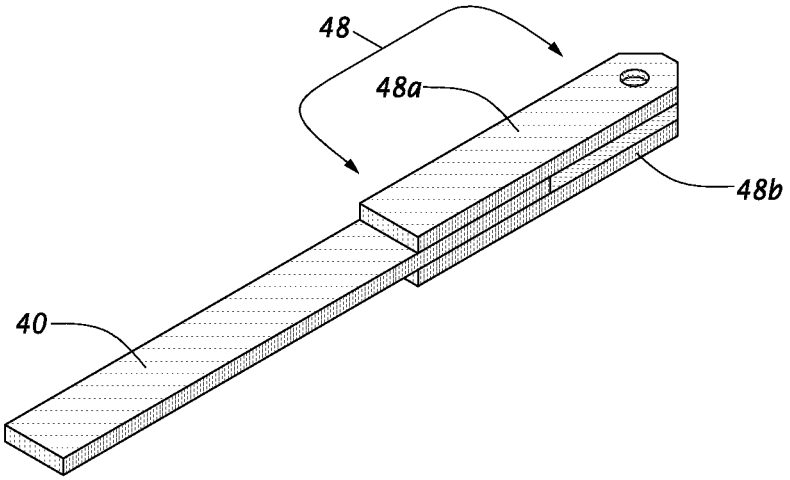

As seen in FIG. 4D, when using a flat bracing member 40, a double shear connection is configured, in one embodiment, by attaching mounting ears 48*a*, 48*b* on each face of the flat bracing member 40. As such, a simple and inexpensive symmetrical attachment end is created.

Figure 4B:
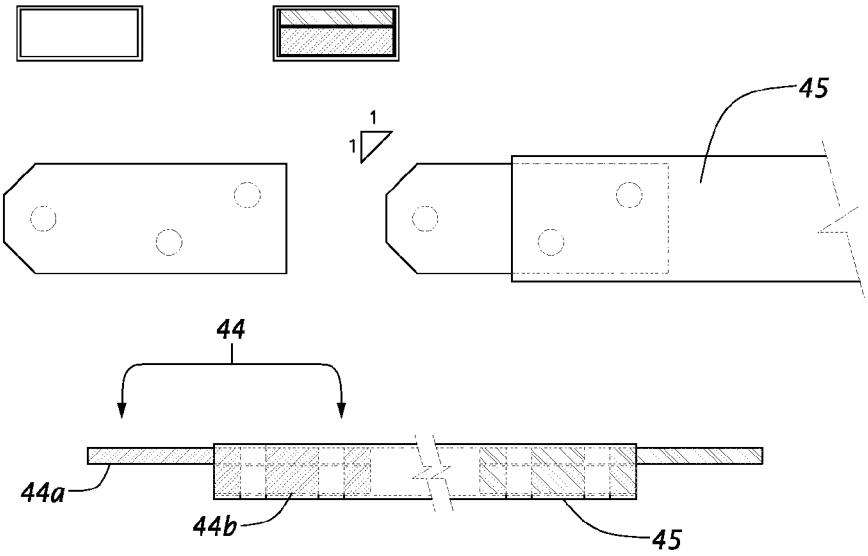

In the case of a tubular bracing member 45 (FIGS. 4B and 4C), one or more plates 44*a*; 44*b*; 49*a*; 49*b* are arranged on one or more ends of the bracing member 45. In some embodiments of the bracing member mounting end 44; 49, the mounting end is pre-assembled and is inserted into an end of the tubular bracing member 45. Such assembly may include only a single solid piece of metal, but preferably may include multiple parts. FIG. 4B illustrates a "single shear" mounting end, in which one component of the mounting end 44 acts as a mounting ear 44*a*, while a second component acts as a spacer 44*b*, to secure the mounting end 44 to the tubular bracing member 45.

Figure 4C:
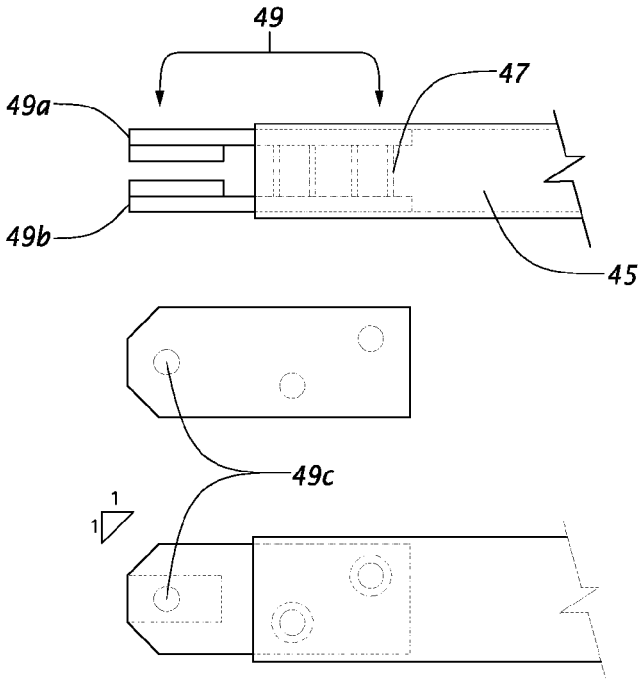
Figure 5:
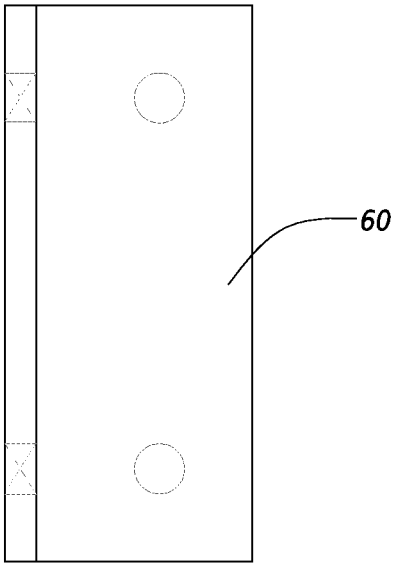
FIG. 5 illustrates a single splice member for joining ends of flanged tube structural members of a preferred embodiment to one another.

As seen in FIG. 4C, to create a double shear mounting end 49, mounting ears 49*a*; 49*b* are assembled to sit against opposite interior walls of the tubular bracing member 45. Prior to assembly with the bracing member 45, cylindrical spacers 47, which may be manufactured from segments of standard pipe, are inserted between and attached to mounting ears 49*a*; 49*b*, typically by welding. Later, the mounting end 49 may be secured into place within the tubular bracing member 45. Again, the attachment may be accomplished by welding or alternatively, bolts may be used, the bolts passing through the cylindrical spacers 47, or elsewhere if practical.

In certain situations, it is necessary to have a more secure connection than in others. As seen in FIG. 4C, one way of achieving an increased level of rigidity and security for the subject structural systems is to equip each end of the bracing members 45 with a "double shear" connection end 49. With such an end, two matching ears 49*a*; 49*b* are attached to each end of the bracing member 45, and extend away from the bracing member 45, parallel thereto. Each ear 49*a*; 49*b* that extends from the bracing member 45 includes at least one hole 49*c* for attachment to other structural components, such as the flange of a structural member 1. When the double-shear equipped bracing member 45 (in FIG. 4C) is attached to a structural member 1, only a pin need be inserted through the joint to fully restrict relative linear movement. In comparison, with a "single shear" connection, as shown in FIG. 4B, where a bolt would be necessary to fully restrict relative linear movement between components. By adding a second hole in the connection end 49, corresponding to a second hole in another structural component, such as the structural member 1, relative rotational movement between the assembled components can additionally be prevented. With the double-shear connection, assembly times are reduced since time is not required for fastening a nut to a bolt. Instead of a nut, only a cotter pin or the like is necessary for preventing the pin from falling out, thereby decreasing assembly time and associated costs. As still another alternative, a self-locking pin can be utilized. Such pins have retractable projections that prevent accidental removal.

Figure 3A:
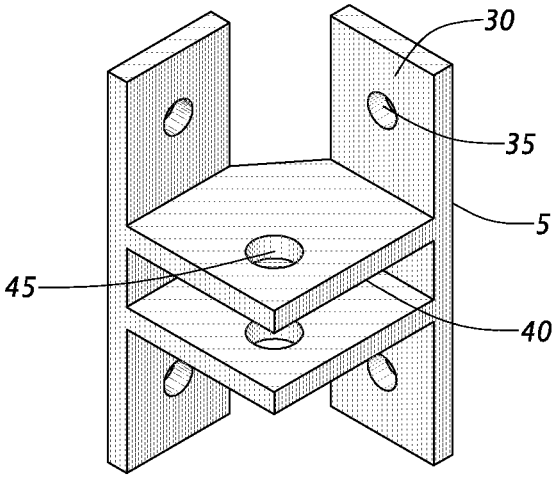
FIGS. 3A-3F illustrate exemplary connection adapters for the flanged tube structural member of a preferred embodiment.
Figure 3B:
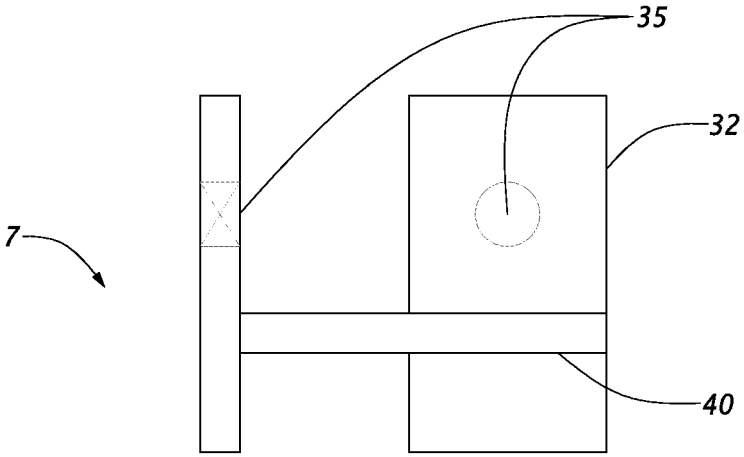
Figure 3C:
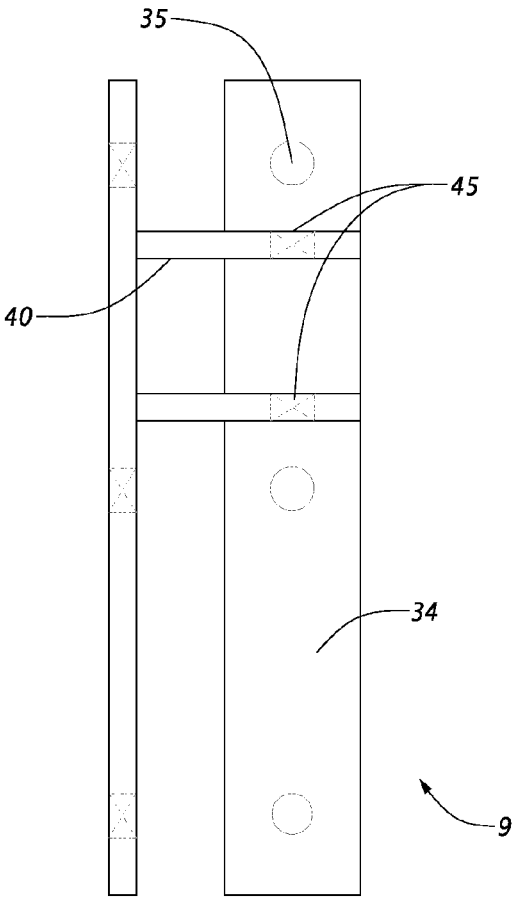
Figure 3D:
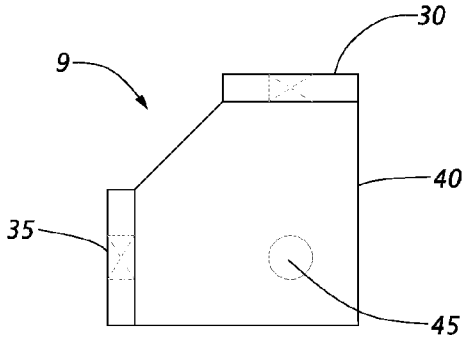
Figure 3E:
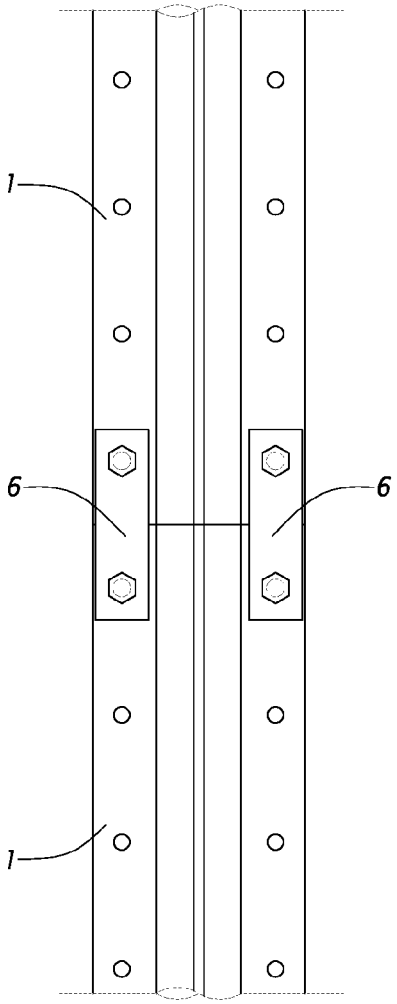
Figure 3F:
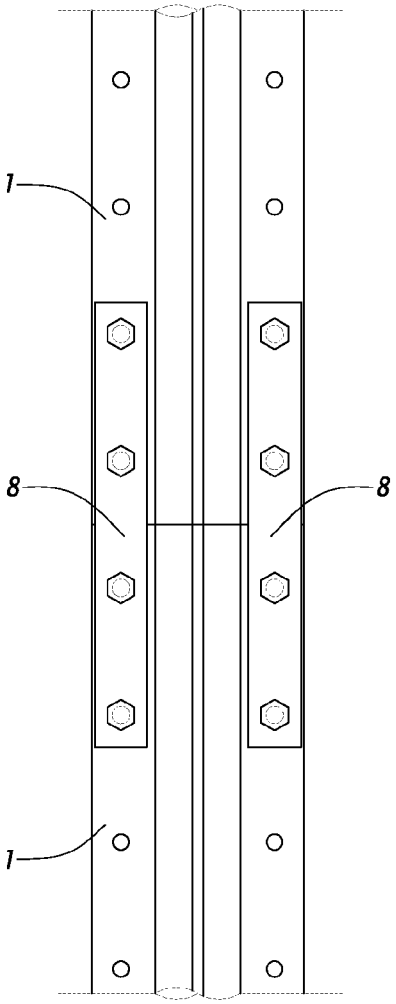

FIGS. 3A-3F, and FIGS. 6A-6C, 7, 8A and 8B illustrate, respectively, nine examples of connection adapters 59, 60, 62, 70, and 80 for the subject structural systems. The connection adapters shown in FIGS. 3E and 3F consist of a pair of flat, elongate plates, the plates being secured by bolts to the flange of the structural member 1, preferably one on each side of the flange. In this case, as with many connection adapters described herein, they are effectively used in sets, for example FIGS. 3E and 3F illustrate use on two opposing flanges at the joints between structural members 1. Connection adapters are not used on the flanges which engage floor support brackets in this embodiment so as not to interfere with slidable engagement of the structural member 1 with the floor brackets. As can be seen, the difference between the connection adapters 6 and 8 is that one version is longer than the other, which advantageously results in a connection with increased stability. The remainder of the connection adapters (FIGS. 3A-D) include at least one vertical plate 30, 32, 34 and one or more horizontal plates 40. The vertical plate 30, 32, 34 includes holes 35 for bolting to the structural member 1. Holes 45 are provided in the horizontal plates 40 for attachment to external bracing members, supports, ties to external structures, such as adjacent buildings, and the like. The connection adapters 5, 9, illustrated in FIGS. 3A and 3C, provide a "double-shear connection" by way of a pair of horizontal plates 40. As such, only a pin need be inserted to restrict linear movement between the connection adapters 5, 9, attached structural system and any additional component or structure. FIG. 3D illustrates a top view of the connection adapter 9, but is also an exemplary top view of the other aforementioned embodiments of the connection adapters 5, 7. To provide further versatility and connection strength, connection adapters which may be used, e.g., as splice elements for connecting structural members directly together at their ends or along their edges will now be described. Such elements are shown in FIGS. 5, 6A, 6B, 7, 8A-8D and 11. The splice elements may be in the form of single 60, 70, double 80, triple 85, quadruple 87 splice elements, etc. The single splice element 60 has a generally U-shaped cross-section but may be two plates 70 bolted together. The double splice element 80 has a generally H-shaped cross-section. Any of these splice elements may be manufactured by extrusion or another suitable method. All splice elements include fastening holes for pinning or bolting to structural members 1. These splice elements may also be used to connect gifts or braces to vertical members 1.

Figure 8A:
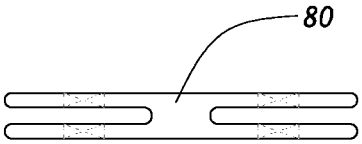
FIGS. 8A-8D illustrate an exemplary splice members for connecting the flanged tube structural members of a preferred embodiment to one another.
Figure 8B:
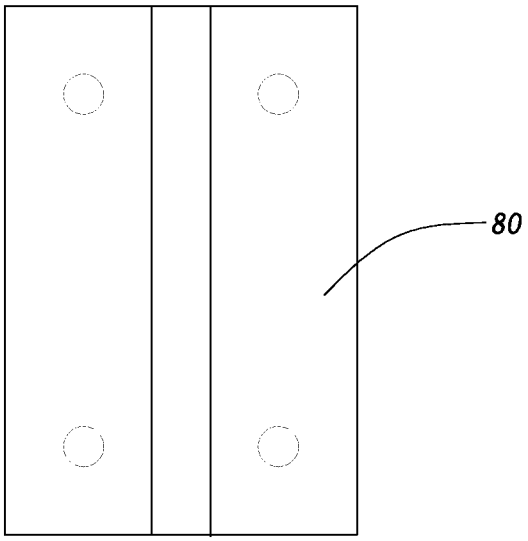
Figure 8C:
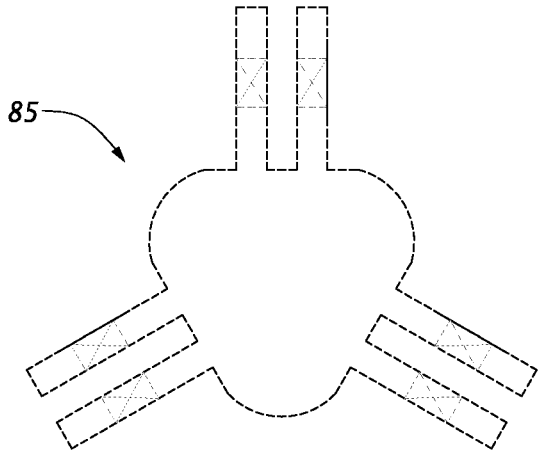
Figure 8D:
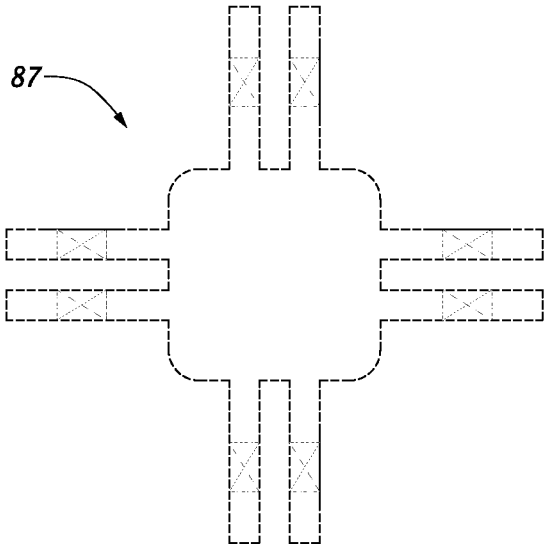

The single splice member 60, 70 is typically used for connecting structural members 1 end-to-end, in order to span distances greater than the length of a single structural member 1. The double splice member 80, as will be described in more detail below, has various applications in creating very strong, versatile structures. Triple and quadruple splice members 85, 87, as shown in FIGS. 8C and 8D can be manufactured in a similar manner to the double splice member, each having a common central core with channels for each structural member.

In use, the multiple splice members (for attaching two or more structural members) can connect structural members along adjacent edges to form wall-like structures to act as retaining walls or supporting structures, or can be used to create tower, column, beam, truss or bridge structures (described in further detail below). The splice members are typically shorter in length than the structural members 1, but alternatively may be any length, equal to or greater in length than the structural member 1 itself, depending on the embodiment. In the presently described and claimed barrier netting system, joining two or more such structural members together may provide, for example, increased global or localized strength and/or stiffness. Of course, it will be appreciated that floor mounting brackets must be configured to accommodate any such joined structural members so that slidable engagement is provided between the floor brackets and vertical support members.

Figure 6A:
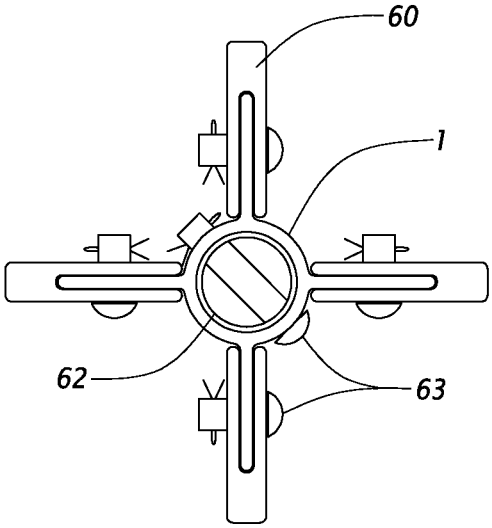
FIGS. 6A-6B illustrate the single splice member and a splice pin for the flanged tube structural member embodiment of the disclosed safety netting system.
Figure 6B:
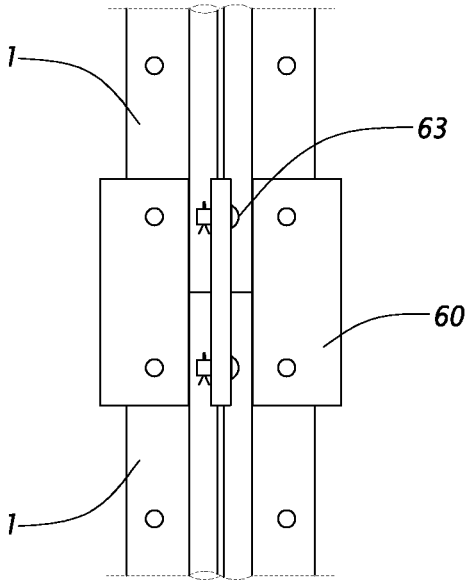
Figure 6C:
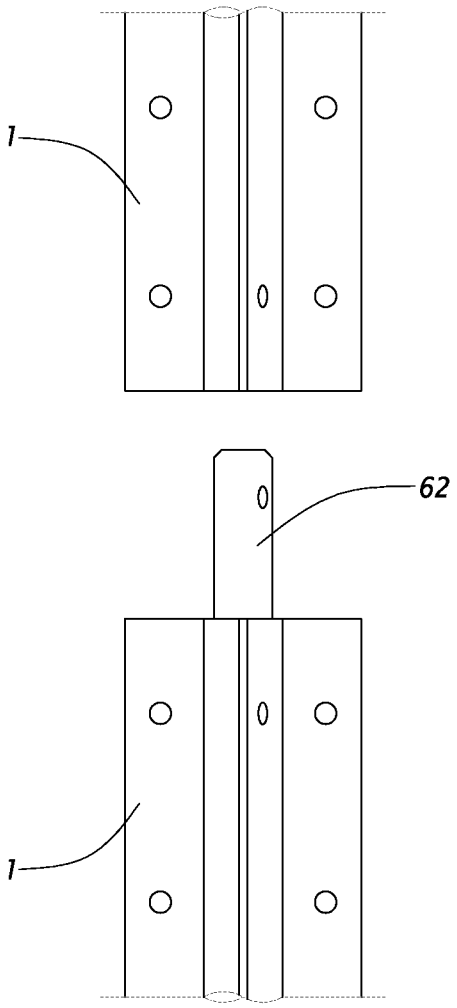
FIG. 6C illustrates the use of a central guiding pin for aligning and/or joining the flanged tube structural members of a preferred embodiment to one another.
Figure 7:
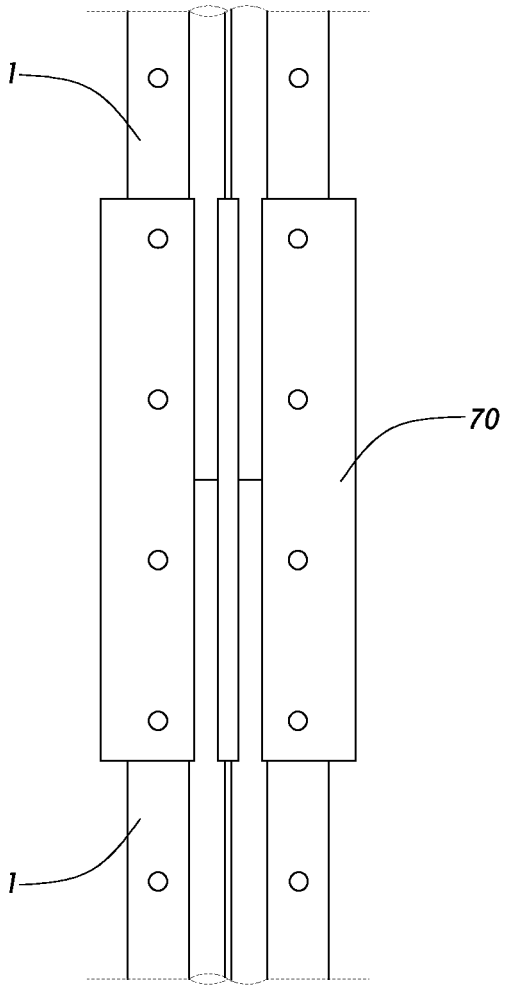
FIG. 7 illustrates splice plates for joining ends of the flanged tube structural members of a preferred embodiment to one another.
Figure 9A:
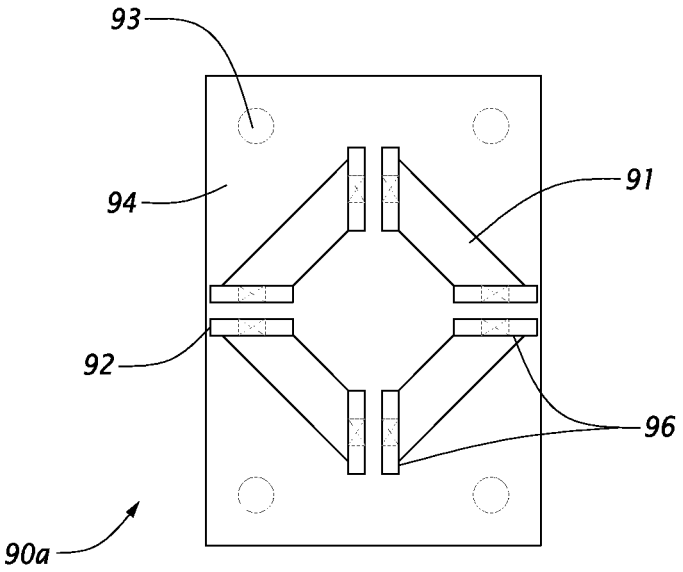
FIGS. 9A-9B illustrate example end caps for the flanged tube embodiment of the subject structural systems.
Figure 9B:
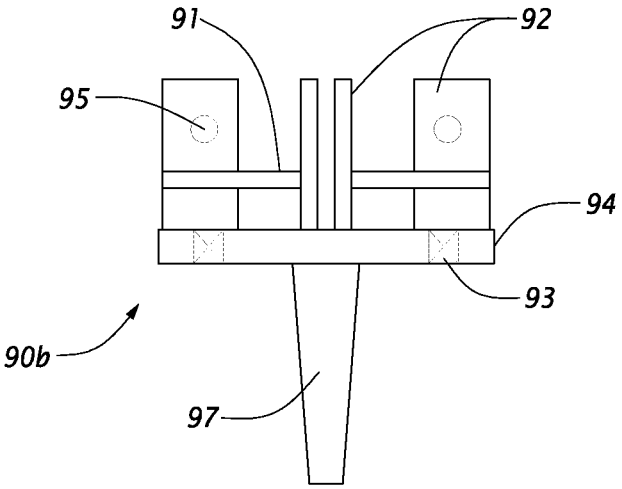

Also shown in FIG. 6C is a splice pin 62 for use in connecting the structural members 1 end-to end, and/or to aid alignment of the structural members 1, when joining them. As seen in FIG. 6B, it is possible to pin the splice pin 62 in location with a cotter pin 63. The cotter pin 63 will hold the splice pin 62 in place, and in combination with the splice pin 62, further increase the strength of a union between structural members 1. FIG. 9A illustrates an end cap 90*a* for attachment to an end of the structural member 1. The end cap 90*a* includes a flange 94 to allow attachment to another component, external structure or accessory, such as a wood beam, floor, roof structure or the like by way of holes 93 in the flange 94. The end cap 90*a* also includes mounting portions 92, which are configured to be perpendicular to the flange 94. Typically, a perpendicular arrangement between the components is desirable, however for special purposes they may be assembled at a predetermined angle, other than a right angle, to the flange 94. The end cap 90*a* attaches to the structural member 1 by way of bolts or pins passing through holes 95 in the mounting portions 92. Additionally, the mounting portions 92 are stabilized by braces 91 attached therebetween. Such braces may be welded to or formed integrally with adjacent mounting portions 92. If formed integrally, a single strip of metal is bent at positions corresponding to joints 96. The two ends are then welded to structural flange 94 with the connecting middle portion acting as a brace 91.

Figure 9C:
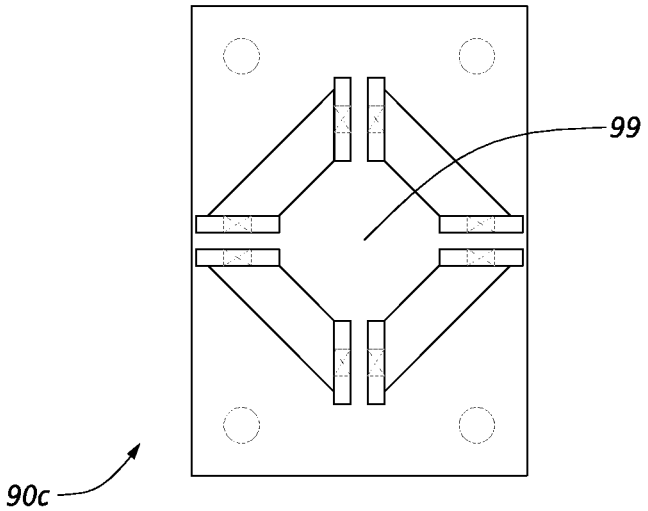
FIGS. 9C-9F illustrate example attachment plates for the subject structural systems.
Figure 9D:
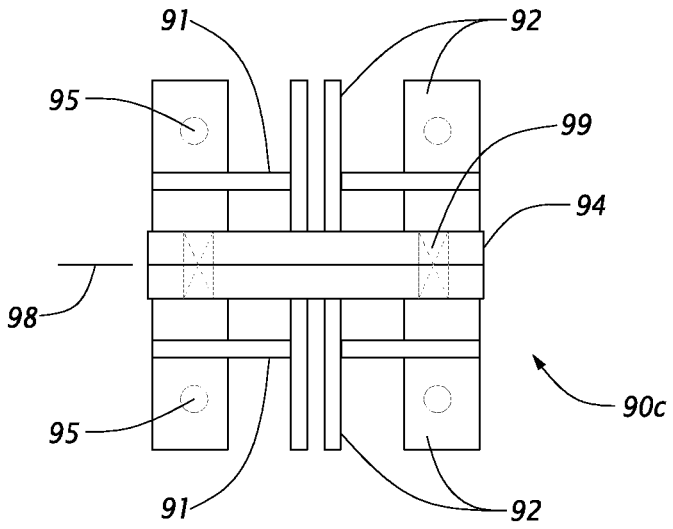
Figure 9E:
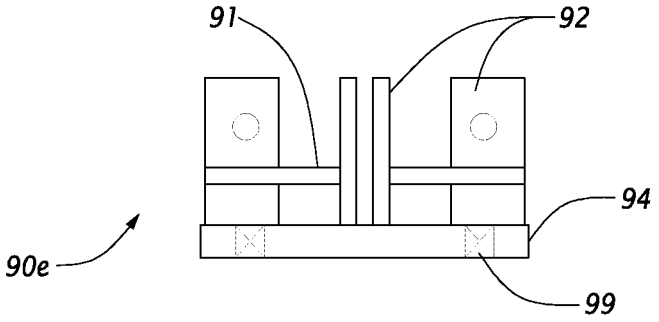

A variation of the end caps 90*a*; 90*b*, are attachment plates 90*c* and 90*e* illustrated in FIGS. 9C-9E. The attachment plates 90*c*, 90*e* provide secure options for attaching platforms, support elements, bracing elements, machinery or other objects to the structural member 1. The attachment plate mounts to the structural member 1 in a similar fashion to the manner in which the end caps 90 mount to the structural member 1. However, the attachment plates 90*c*, 90*e* include an additional central aperture 99 through which the structural member 1 can pass. The attachment plate 90*c* is symmetric about line 98. As an alternative to the attachment plate 90*c* shown in FIG. 9C, an attachment plate 90*e* (FIG. 9E) may include only half of the 10 plate. That is, a variation of the attachment plate comprises the portion of the plate 90*c* that is above (or below) the line 98, and not the other half of the plate. This is useful in situations where reduced strength compared with the "double" attachment plate in FIG. 9C is adequate, and material costs are a concern.

The attachment plate 90*c* may also be configured to act as an adapter between different sizes of structural members 1. That is, in a structure utilizing the structural member 1, if two structural members 1 are arranged adjacently in line (vertically or horizontally), and they have two different diameters, they can be joined by the attachment plate 90*c*, having two sides, each sized according to the size of the structural member 1 attached thereto. Alternatively still, if so-desired and to provide additional flexibility, the "double" attachment plate 90*c* can be approximated by bolting two "single" attachment plates 90*e* together, each matched in size with the structural member 1 to which it is to be attached.

Figure 9F:
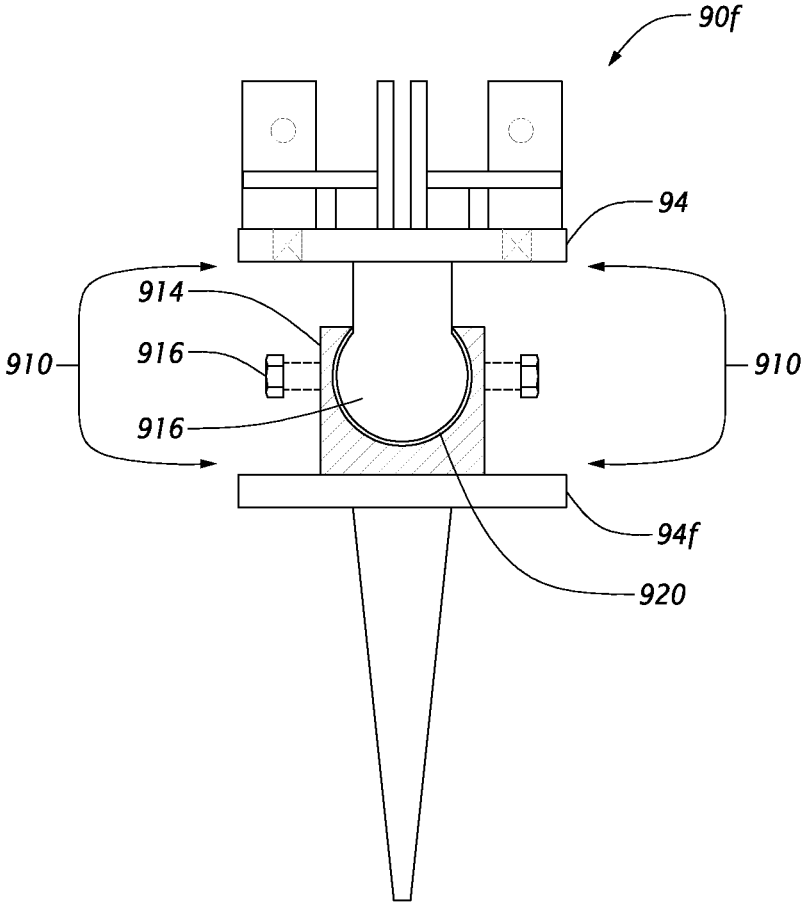
Figure 10:
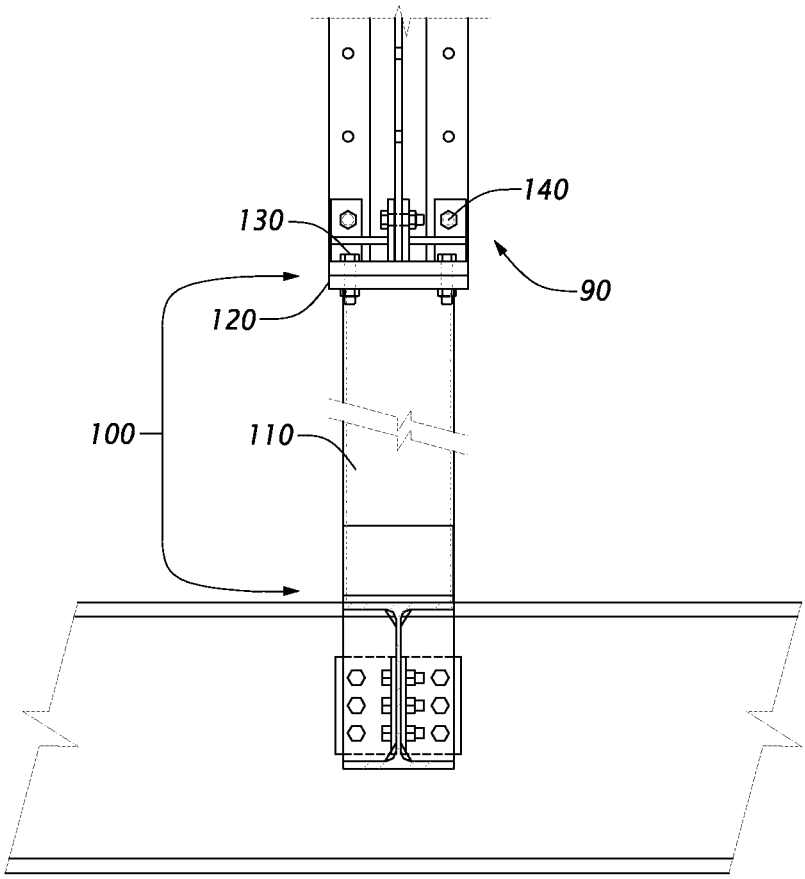
FIG. 10 illustrates an exemplary use of the end cap for the subject structural systems.
Figure 11:
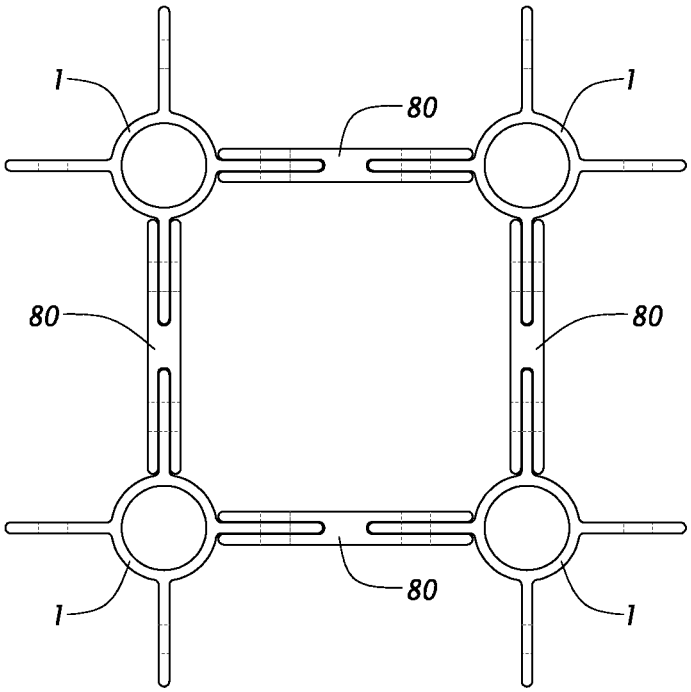
FIG. 11 is a cross-sectional view of a truss or column assembly according to one embodiment of the present invention.

A further variation of the end cap 90*a* and spiked end cap 90*b* is pivotable end cap 90*f* which may include spikes on its bottom if desired. Pivotable end cap 90*f* includes adjustable components that allow correction of irregularities in underlying pavement or slight errors during insertion of the spiked end cap into soil. While different arrangements for adjustability of the pivotable end cap 90*f* are possible, the embodiment illustrated in FIG. 9F shows a ball-in-socket joint 910 arranged between the flange 94 and lower flange 94*f*. The ball-in-socket joint includes a ball affixed to the flange 94 as shown in FIG. 9F, while the lower flange 94*f* includes an attached cylindrical socket 914 which engages the ball. The ball is rotatable within the socket 914, until set screws 916 are tightened to prevent the ball from rotating. Naturally, the relative positions of the ball and socket 914 may be switched such that the socket is above the ball. Additionally, a bearing 920 may be inserted in the socket to distribute the load more evenly. Such a bearing 920 may be made from a dense, durable material, such as high-density polyethylene. FIG. 10 illustrates the end cap 90*a* used as a connector between structural member 1 and a separate structure or structural member 100. Holes enable attachment to the other structure or structural member 100, comprising, in this particular embodiment, a steel tube 110 having an attached plate 120 at an end nearest the end cap 90*a*. The end cap 90*a* is bolted to the plate 120 of structure or structural member 100 using bolts 130. In turn, the structural member 1 is attached to the end cap 90*a* via bolts 140. Of course, it will be appreciated that in this and other embodiments of connection mechanisms, floor mounting brackets must be configured to accommodate any such joined structural members so that slidable engagement is provided between the floor brackets and vertical support members. Exemplary embodiments of connection mechanisms which may be used in particular or unique circumstances in concert with the described and claimed invention are detailed herein, but none of the described connection mechanisms are required for practice of the described and claimed invention.

Figure 12A:
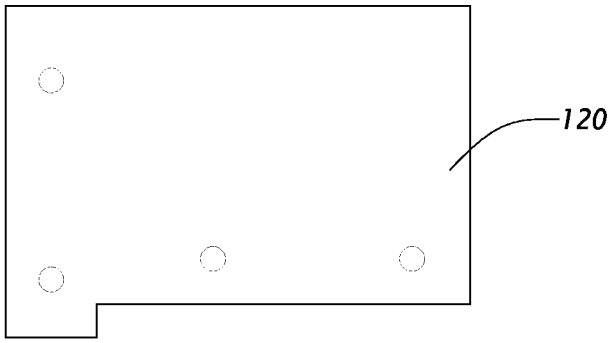
FIGS. 12A and 12B illustrate two embodiments of gusset plates for use in the subject structural systems.
Figure 12B:
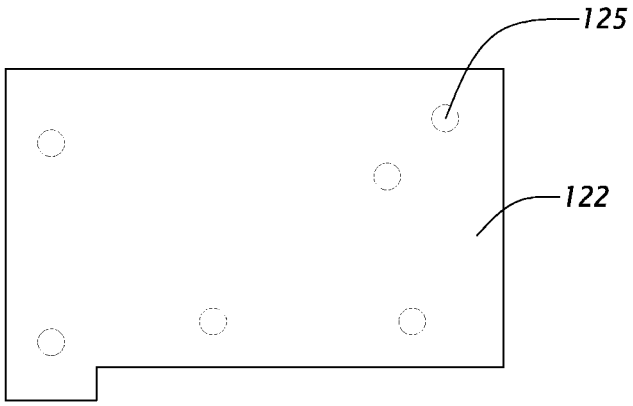
Figure 13A:
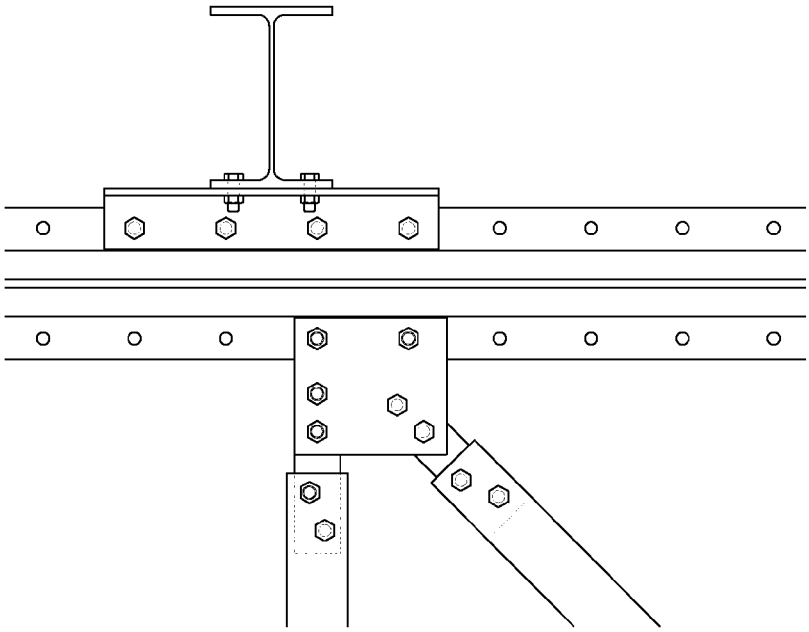
FIGS. 13A and 13B illustrate example connections in the subject structural systems.
Figure 13B:
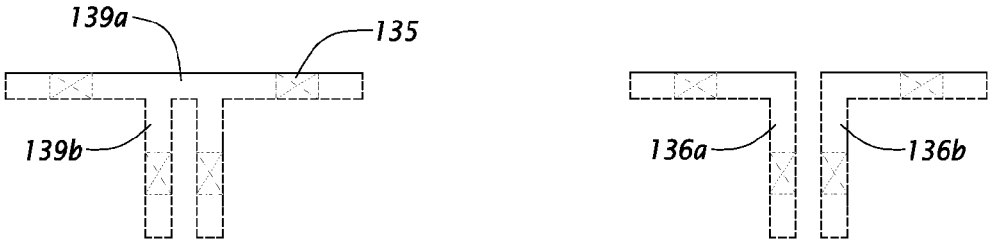

FIGS. 12A and 12B illustrate example gusset plates 120, 122 for use in rigidifying connections between the structural member 1, bracing members, and/or other structural components. FIGS. 13A and 13B additionally illustrate the manner in which a traditional I-beam or other substantially flat metal components may be integrated into the subject structural systems, and attached to the structural member 1. A single or a pair of angle iron 136*a*; 136*b* (shown in FIG. 13B) may be attached between a flange of the structural member 1 and the I-beam as shown at the top of FIG. 13A. Alternatively, a single-piece adapter 135 (also shown in FIG. 13B) may be used. This single piece adapter 135 simplifies assembly by providing both a "double shear" connection to the structural member, and by eliminating the need for a work person to maneuver an additional structural component. The single piece adapter also experiences reduced bending stresses, since the upper flange 139*a* is secured by two lower mounting portions 139*b* that stably mount the adapter 135 to the structural member 1.

Figure 14:
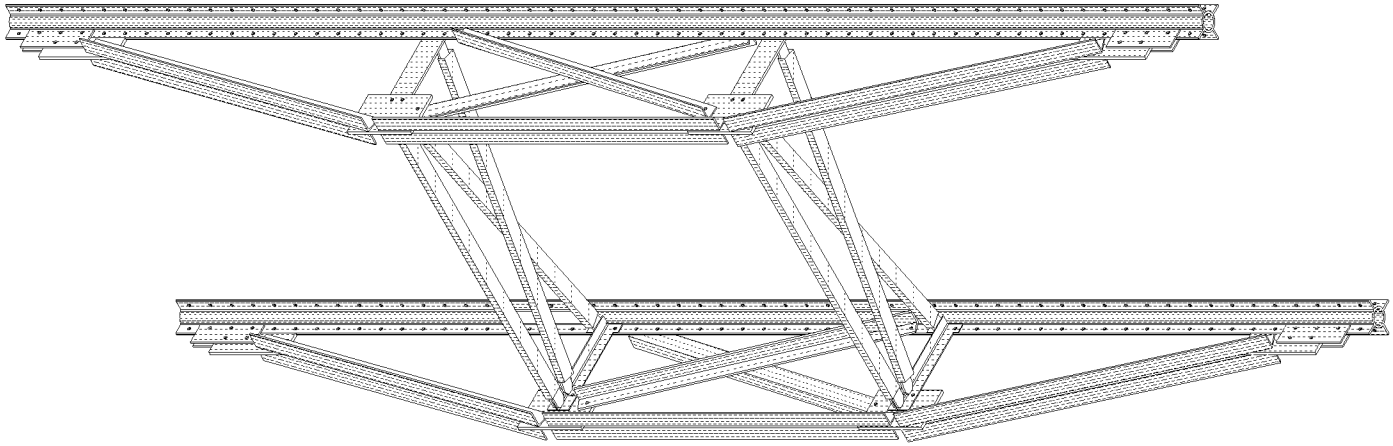
FIG. 14 illustrates a cantilevered support structure for increasing rigidity in one embodiment of the subject structural netting system.

A cantilevered leg structure may be used to provide increased rigidity to the vertical column member structure to increase resistance to, e.g., wind loading. In such structure, a king post truss system may be used as known in the art and as shown in FIG. 14. However, it is not believed that such a cantilevered structure, or any such additional stiffening or strengthening components beyond the vertical column members and their supports alone, should be necessary for most implementations of the system described herein. A situation where the use of such a cantilevered leg structure may be appropriate is where it is desired to extend the barrier net structure up above the highest floor mounting brackets by a substantial amount.

The safety netting system described herein may be anchored to the building under construction by floor brackets, which may be placed, in one embodiment, 6 to 8 ft. apart depending on building dimensions and conflicts, i.e., curtain wall inserts, vertical risers or permanent column locations.

Figure 15:
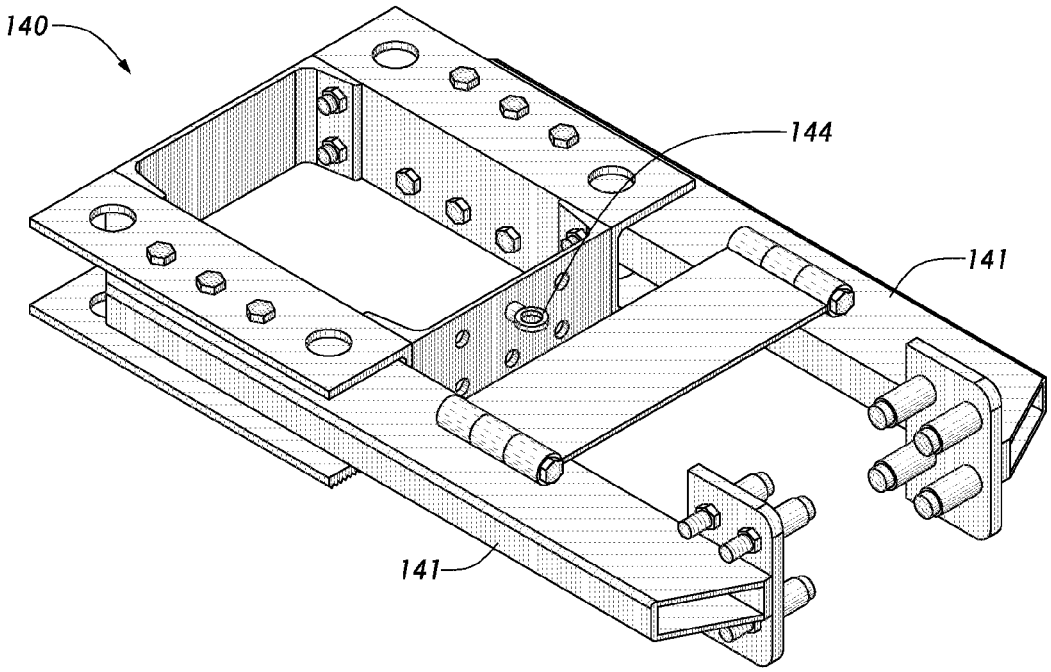
FIG. 15 illustrates a floor bracket used in one embodiment of the subject structural netting system.
Figure 15A:
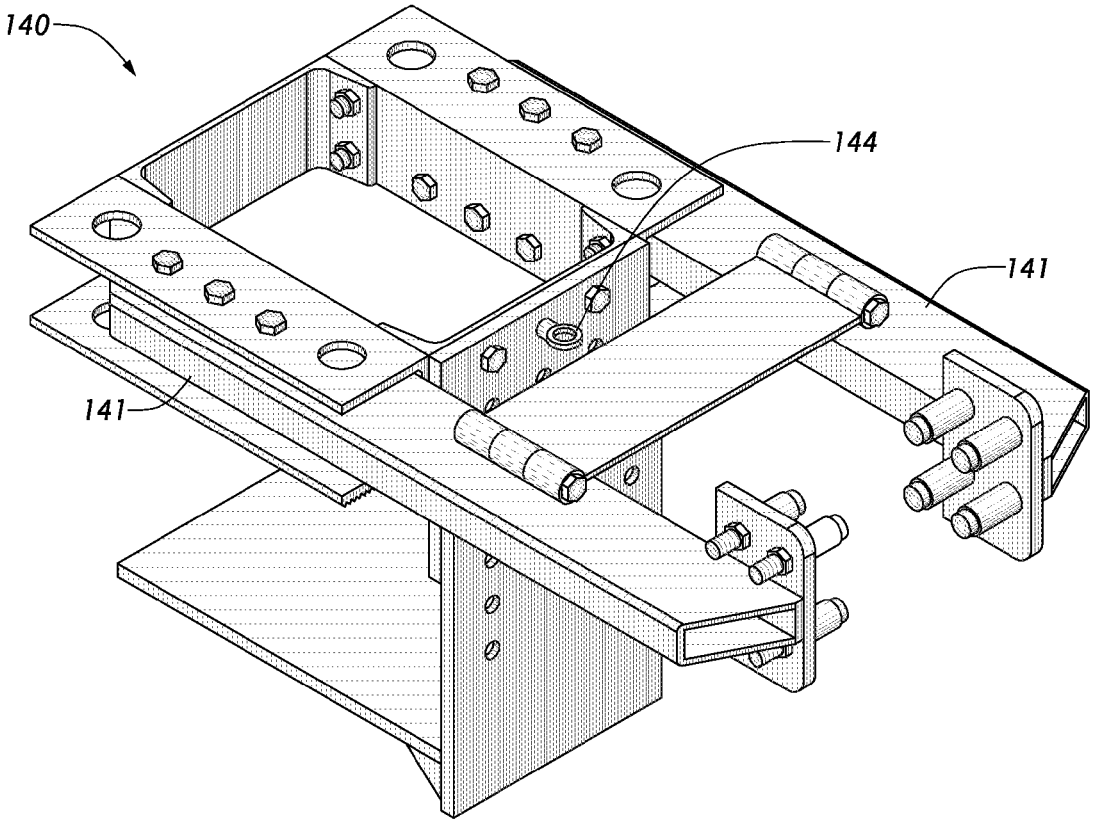
FIG. 15A illustrates a floor bracket used in one embodiment of the subject structural netting system which may be attached to a concrete deck via compression.

The floor brackets with which the structural members 1 are slidably engaged may be held in place in either of two ways, either bolted to the slab or via compression brackets. In the bolted situation, inserts may be installed in the concrete deck to which the brackets are bolted, or holes may be drilled in the slab and anchor bolts set in place which are then attached to the brackets. FIG. 15 shows an exemplary bracket which may be bolted to a concrete deck. In the case of compression brackets, a surface (which may be ridged) of oppositely facing plates of the bracket grabs the top and bottom of the slab when opposing force is applied to the opposing bracket plates, thus clamping the brackets to the slab. FIG. 15A shows an exemplary bracket which may be attached to a concrete deck via compression. The concrete-facing side of, e.g., a plate used in such an embodiment may be roughened, ridged or provided with such similar means for providing frictional or other resistance to movement once force is applied between the bracket and the slab etc. to which the bracket is attached. It is to be understood that any other means for securing the floor brackets to a floor, deck or slab of a building is within the invention contemplated herein. It is also to be understood that floor brackets may be replaced either partially or completely by brackets attached to structural beams, columns or other members of the building structure and in such case the brackets would be attached in known manner including, e.g., bolting, welding, or clamping.

When used, floor brackets are advantageously made of aluminum to reduce weight. In one embodiment, the floor bracket components may be extruded from custom dies. In such embodiment, the floor bracket components are advantageously bolted together, either partially or completely, so as to reduce or negate the requirement for welding, which thus minimizes or eliminates the need to inspect welded joints. In an exemplary embodiment, shown in FIG. 15, a floor bracket has a rectangular frame that houses two custom shaped 5 inch by 2 inch tubes 141 that act as arms/support brackets cantilevering from the edge of a floor slab by 18 to 36 inches. The ends of the tubes support a 6 inch by 8 inch by ½ inch thick plate holding four custom roller pins 142 for receiving a star leg column. When brackets other than floor slab brackets are used in this embodiment, such brackets are slidably engaged with the vertical support members 1 in substantially the same manner as floor brackets, the difference being only in how the brackets are rigidly connected to the building structure.

Figure 16:
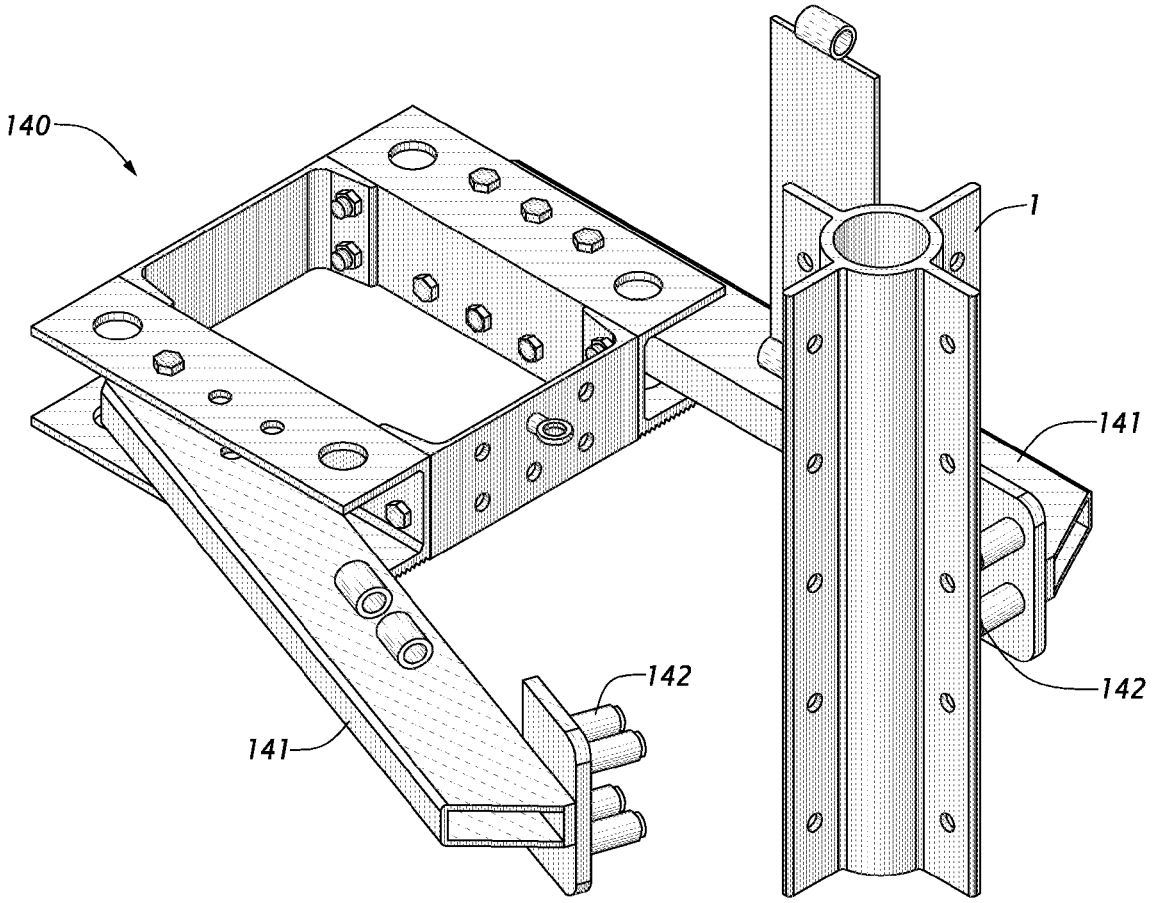
FIG. 16 illustrates a floor slab bracket of one embodiment of the invention which can be opened and closed around a flanged tube in a scissor fashion.
Figure 16A:
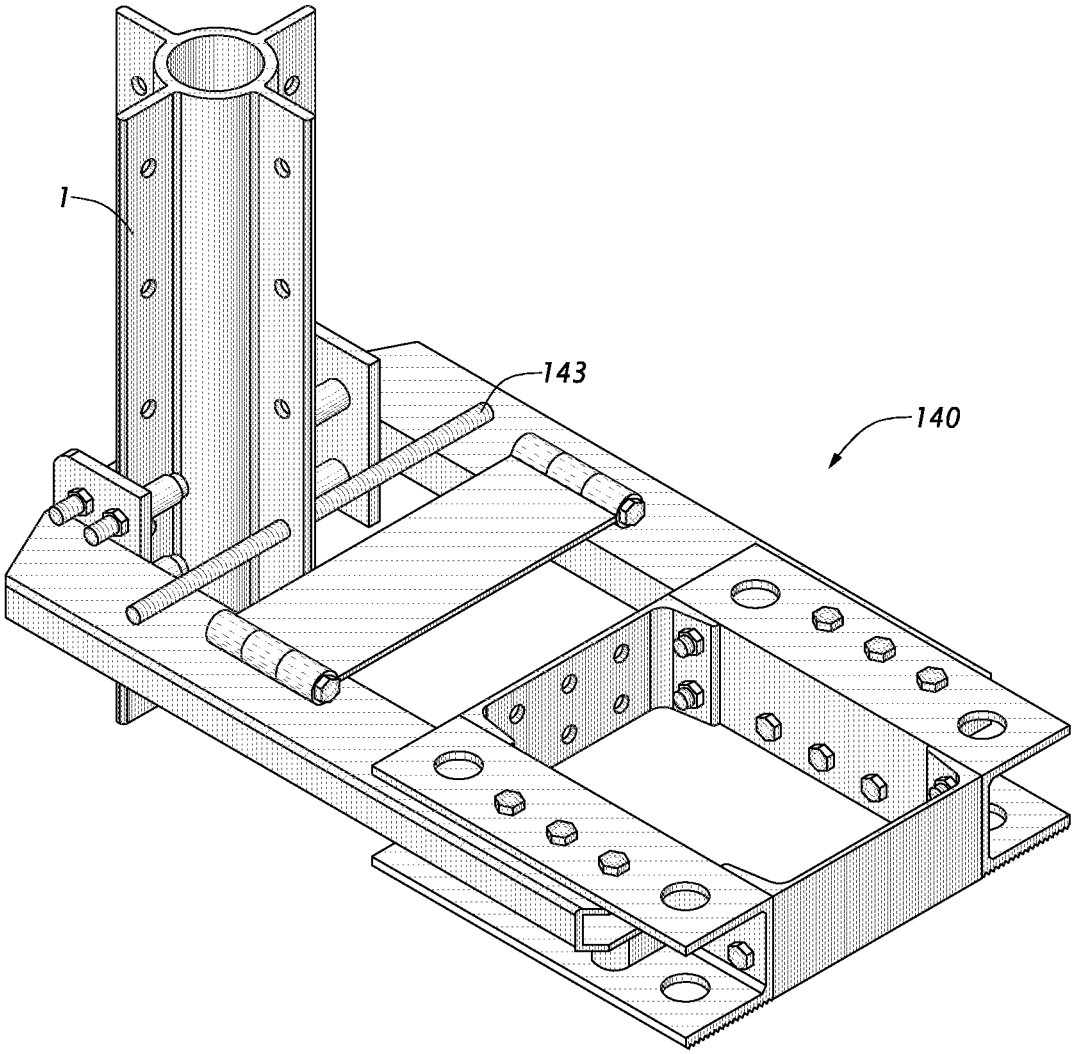
FIG. 16A illustrates a floor slab bracket of one embodiment of the invention closed around the flanges of a vertical tube structural support member.
Figure 17:
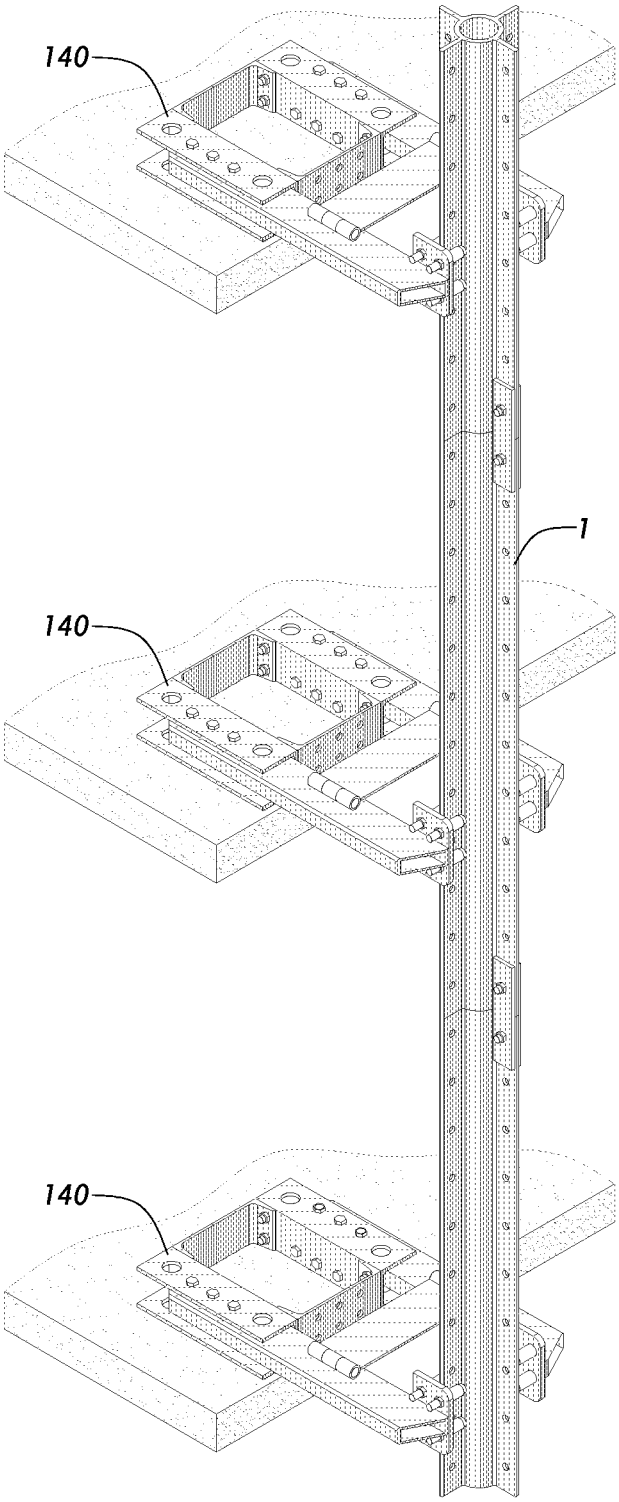
FIG. 17 illustrates a floor slab bracket of one embodiment of the invention including rollers which guide a flanged tube vertical support member as the support member is raised to move up the building as construction proceeds by engaging two fins of a flanged tube star leg structural member.

As shown in FIGS. 16 and 16A, after a floor slab bracket has been secured to the slab, the arms can be opened and closed like a scissor engaging/surrounding the star leg vertical member 1. FIG. 16 shows the floor bracket in an open configuration and FIG. 16A shows the floor bracket arms 141 closed around two vertical member flanges so as to create slidable/rollable engagement such that the two fins of the flanged tube star leg are guided between the rollers 142 as the vertical members are raised to move up the building as construction proceeds. FIG. 17 shows a vertical column member configured on a building in slidable/rollable engagement with floor brackets 140 on three different floors. This mechanism provides the desirable aspect of eliminating the requirement for an extensive amount of structural material rigidly attached to the building to support the slidable structure. In this manner, the system described and claimed herein provides substantial advantages over, e.g., the UBS system described above. In the disclosed and claimed system, all or a substantial part of the vertical support structure in a safety netting system is slidably engaged with building mounting brackets so as to minimize the amount of structure required which would appreciably reduce the overall weight of the system.

The third fin (flange) of a star leg vertical support member of a preferred embodiment supports the perimeter net. The fourth fin acts as an anchor point to raise the star leg pole and also to act as a support to prevent the leg from falling down from the effects of gravity. The substantially vertical column members 1 may be locked to the floor brackets in any known manner to secure them after positioning, including, e.g., by inserting pins 143 through holes in the fourth fin above the bracket roller guides once the netting structure is placed in the desired operational position. The system may rely on the force of gravity alone, via such a pin 143, to prevent the columns from falling or sliding down through the rollers, as shown, e.g., in FIG. 16A. A fully bolted attachment between column and floor bracket may also be used in any known manner. Still further, a separate mechanism may be attached to the building structure, including either beams or floor slabs or structures, to provide a "stopping" mechanism for the substantially vertical column support members once they have been positioned after a move up the building as construction proceeds. Still further, a ratcheting mechanism may be used to elevate the vertical column members and to retain them in the desired place. Such a mechanism may include, for example, teeth formed on the fourth fin which may engage a jacking mechanism which applies vertical force to the column members via resistive engagement with a floor slab or other fixed building structure. In such an implementation, pins or bolts may not be required to hold the vertical members in place in a desired configuration, although it may be desirable to use safety or backup pins or mechanism in such implementation. A frictional clamping mechanism may also be used to secure and maintain the vertical support members in place in a desired vertical location. Such clamping mechanism may be engaged between the floor bracket and column member or it may be attached directly to the building concrete slab or other building structure and apply frictional claiming force to, e.g., a fin of the column member directly, or may engage another part of the vertical column members including all or part of the central tube portion. Any mechanism for maintaining a desired vertical location of the support member is within the spirit and scope of the present disclosure. The structural members 1 and their attached barrier netting may, in one embodiment, be lifted by use of a winch device or the like rigidly attached to, e.g., the building slab at one end via an eye bolt 144 mounted in a floor bracket, as illustrated in FIG. 15. As can be appreciated, any known device or method for elevating the vertical structural support members and netting during vertical progression of a building is within the scope of the invention.

Figure 18:
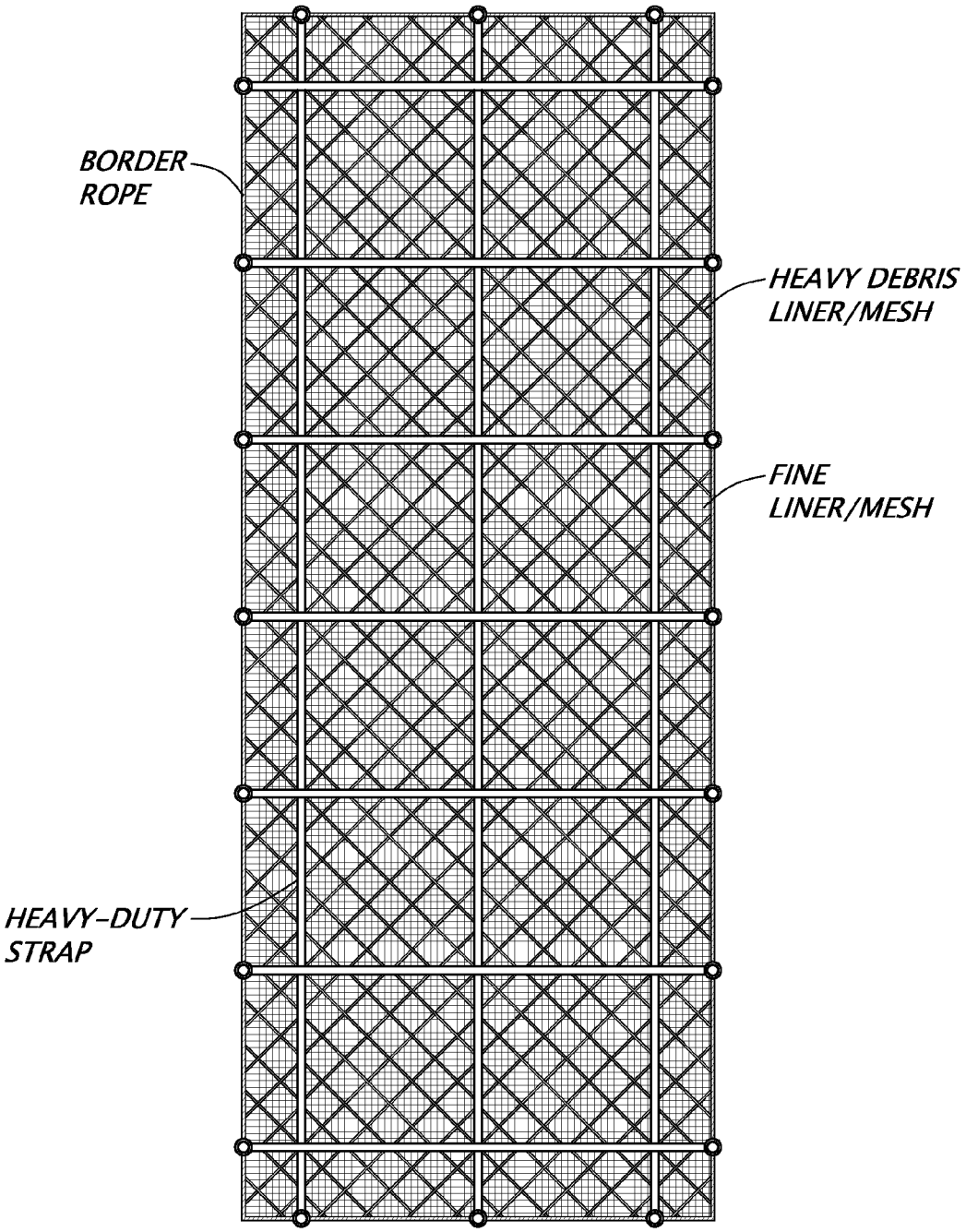
FIG. 18 illustrates an exemplary safety netting arrangement for use in one embodiment of the subject structural netting system.

As shown in one exemplary embodiment in FIG. 18, the safety netting of a preferred embodiment of the safety netting or barrier system described and claimed herein is fabricated in panels sized in one embodiment to be typically 8 feet by 25 feet. These panels may be advantageously sized to match the spacing at the vertical support tubes, i.e., 6 feet by 25 feet or 7 feet by 25 feet etc. The nets may have a border rope, heavy duty strap, or the like that supports both a heavy debris liner of about ¼ inch dimension spaced approximately 4 to 6 inches on center and also a fine liner of about ⅛ inch dimension twine spaced ¼ inch on center. In addition a 2 inch heavy duty strap may be placed every 2 feet horizontally forming a triple safety type net designed to stop most types or forms of construction debris from blowing off the top of the building during forming and stripping operations. This particular netting configuration also prevents debris from penetrating the netting in high wind storms. However, it should be appreciated that any barrier mechanism which is appropriately configured to prevent transmission of whatever is desired to stop may be used as the netting or barrier mechanism. Mesh barriers are envisioned as a principal barrier mechanism, but other barrier mechanisms are contemplated for use with the netting system of the present disclosure, including, for example, solid barriers that may be lightweight composite, metallic, or non-metallic systems. The barrier mechanisms may also be translucent, non-translucent or any variation thereof. As can be appreciated, use of flexible barrier netting structures in the described system allows a great deal of leeway in use of the system in structurally unconventional or irregular geometric situations. For example, one such situation may be where the flexible netting allows the vertical support member location to be changed, e.g., moved side to side, to accommodate building variations such as exterior column location changes. Use of a flexible net makes this a simple process. Still further, netting flaps may be employed to connect net panels together in the vicinity of a vertical support member. Such use of flaps in this manner allows substantial leeway in designing, installing and reconfiguring nets during use of the entire system. These flaps would connect net edges together so that objects do not pass through the net system in the vicinity of net panel connection points, e.g., around vertical column members or other connection points.

Also contemplated for use in the presently described system are barrier structures which may be substantially permeable to rain, snow, or wind but which are effectively solid barriers when viewed macroscopically as regards very small articles which may be dropped from a high-rise construction area. Use of such a barrier would prevent the deleterious effects of precipitation buildup or susceptibility to wind-induced forces but would prevent very small articles from passing through the barrier. This could be critically important as very small articles dropped from high buildings can wreak substantial damage to pedestrians, workers or property at street level having had a very long time during descent to accelerate to terminal velocity. Still further, the fine liner of the barrier netting structure may be releasably attached to the vertical support members or other components of the barrier net structural support system in order to prevent catastrophic failure of the entire system when subjected to excessively high winds or precipitation buildup. In such an embodiment, the fine liner would be designed to detach from its supports on one or more sides at a predetermined threshold loading level of, e.g., wind speed, a combination of wind speed and precipitation weight, or the like depending on particular requirements. In this embodiment, the larger components of the net would preferably remain rigidly attached and thus still provide a barrier for large objects which may be wind-blown or dropped from the construction deck or other location.

In a preferred embodiment, such as shown in FIG. 17, a minimum of three floors with brackets are necessary to support the vertical star leg columns and installed netting system. It should be appreciated, however, that more bracketed floors could be used to support heavier systems and two floors of brackets could be used in a system designed with lighter-weight components. As also shown in FIG. 17, and consistent with the exemplary embodiment shown in FIGS. 3E and 3F, this particular embodiment involves joining vertical support structural members 1 by employment of connection adapters on two opposing flanges of the vertical support structural members at the joints between individual lengths of structural members 1. This embodiment avoids the necessity of hoisting exceedingly long and heavy vertical members to the work location which is in many instances several hundred feet above the ground, if not much higher. The desired length of vertical structural member can be assembled at the point of use depending on the job requirements. Connection adapters are not used on the structural member flanges which engage floor support brackets in this particular embodiment so as not to interfere with slidable engagement of the structural member 1 with the floor brackets, as can be appreciated from FIG. 17 (connection adapters can be seen on the inward facing flange of the vertical support members 1; the connection adapter on the opposing flange is not visible in this particular Figure, although it would normally be used in this particular embodiment). The floor support brackets can also hold horizontal planks, netting or other barrier materials thereby minimizing any danger of debris falling down between the outside net and the floor slab edge.

Figure 19:
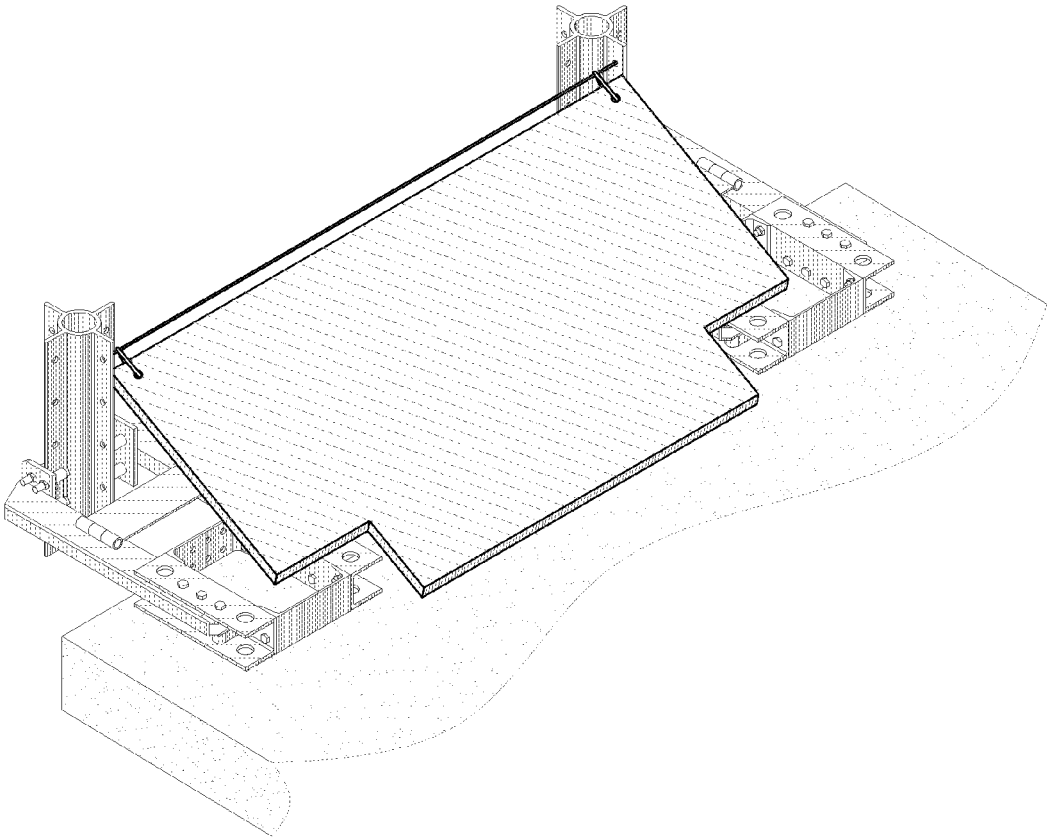
FIG. 19 illustrates an exemplary safety netting arrangement for use in one embodiment of the subject structural netting system wherein a horizontal barrier may be rotatably mounted to vertical column support members and then clipped to the netting, cable or post structure during movement of the system to a new floor.

A rigid or semi-rigid horizontal barrier may be configured for attachment to the vertical columns or other part of the netting system such that when it lies flat it contacts the bottom most floor slab in the vicinity of the netting structure to prevent debris from falling between the net and the building structure. In one embodiment, the horizontal barrier may be rotatably mounted to the column members and then clipped to the netting, cable or post structure during movement of the system to a new floor as shown in FIG. 19.

It is to be understood that other applications for, and combinations of, the subject barrier netting system are possible, and that though not specifically set forth in this document, that the spirit of the invention may be practiced in other ways.

The invention claimed is:

1. A safety barrier system for use in multi-story building construction or maintenance comprising: at least one elongated safety barrier net which is capable of extending from the proximity of the edge of one floor, deck or slab of a building structure and projecting upwardly to a higher level above the level of the edge of a superimposed higher floor, deck or slab of the structure by an amount sufficient to constitute an effective safety barrier for workers located at said higher level and to provide a barrier to prevent debris from falling from the higher or adjacent levels, wherein said safety barrier net is flexible, wherein said safety barrier net is fixedly attached to at least two vertical support members such that the barrier net is held in place substantially parallel to the exterior plane of the building to be constructed or which is being maintained, each said vertical support member being slidably engaged with a bracket structure and wherein said bracket structure is fixedly attached to an outer edge of a floor, deck or slab of said building structure, wherein said vertical support member is slidably engaged with a portion of said bracket structure which extends past the edge of said floor, deck or slab and wherein said superimposed higher floor, deck or slab is either a future floor or slab to be constructed or is incomplete, wherein the barrier net is comprised of a border rope that supports a heavy debris liner comprised of strands, twine or rope approximately 3/16 inch diameter spaced approximately 4 to 6 inches center to center, a fine liner comprised of strands, twine or rope approximately ½ the diameter of the heavy debris liner spaced approximately ¼ inch center to center and an approximately 1 inch diameter heavy duty strap placed approximately every foot horizontally, thereby forming a triple layer safety net to stop construction debris from blowing off said higher or adjacent levels of a building during construction operations.

2. The safety barrier system of claim 1, wherein the height between a first floor, deck or slab of a building under construction or maintenance and a superimposed second floor, deck or slab one floor higher has a predetermined value, said vertical support members are extendable to or beyond said predetermined height of the superimposed second floor, deck or slab and said vertical support members are capable of being extended upwardly a sufficient distance to enable said safety barrier net to be elevated, in positioned relation between the vertical support members, and extending above said superimposed second floor, deck or slab, to constitute an effective safety barrier above, below and at the level of said superimposed second floor, deck or slab.

3. The safety barrier system of claim 1 further comprised of multiple elongated safety barrier nets and wherein said nets and support structure comprise a safety barrier substantially enclosing either the perimeter of the top of a multi-story building or an area of a building under construction or maintenance.

4. The safety barrier system of claim 1 wherein said vertical support member is slidably engaged with the bracket structure via roller wheels which engage a flange of the vertical support member.

5. The safety barrier system of claim 1, further including bracing or support members situated between said vertical support member and substantially parallel to the plane of the exterior face of the building under construction or maintenance.

6. The safety barrier system of claim 1, further including members comprising toe boards or barriers laterally coextensive with said safe barrier net being of restricted depth sufficient to bridge a gap between the safety net and the adjacent edge of said building floor, deck or slab.

7. The safety barrier system of claim 1, wherein said heavy debris liner is comprised of a coarse mesh for preventing the passage of workers or large heavy articles of debris and said fine liner is comprised of a fine mesh for preventing the passage of smaller articles of debris, said fine mesh portion of said barrier net being releasably attached on at least one side or edge of said barrier net so that said side or edge of said barrier net detaches at a predetermined wind or weight loading.

8. The safety barrier system of claim 1 wherein said bracket structure is comprised of at least two separate bracket members situated at two different floors, decks or slabs immediately adjacent each other so as to guide the vertical support member during vertical repositioning of said safety barrier system and to hold the vertical support member in position during building construction or maintenance.

9. The safety barrier system of claim 1, wherein said bracket structure is comprised of a releasable scissor mechanism which facilitates the capability of releasable slidable engagement of the bracket to a vertical support member, said releasable slidable engagement capability being provided by allowing the bracket to be opened substantially horizontally in opposing directions on either side of a vertical support member.

10. The safety barrier system of claim 1, wherein a truss system is attached to the outwardly facing side of at least one vertical support member to enhance the structural rigidity of the safety barrier system.

11. A safety barrier system for use in multi-story building construction or maintenance comprising: at least one elongated safety barrier net which is capable of extending from the edge of one floor, deck or slab of said building structure and projecting upwardly to a higher level above the level of the edge of a superimposed higher floor, deck or slab of the structure by an amount sufficient to constitute an effective safety barrier for workers located at said higher level and to provide a barrier to prevent debris from falling from the higher or adjacent levels, wherein said safety barrier net is flexible, wherein said safety barrier net is fixedly attached to at least two vertical support members such that the barrier net is held in place substantially parallel to the exterior plane of the building to be constructed or which is being maintained, each said vertical support member being slidably engaged with a bracket structure and wherein said bracket structure is fixedly attached to an outer edge of a floor, deck or slab of a building structure, wherein said vertical support member is slidably engaged with a portion of said bracket structure which extends past the edge of said floor, deck or slab, wherein each of said vertical support members comprises an elongated hollow cylinder, a cross-section of the elongated cylinder having an uninterrupted circular inner contour and a circular outer contour interrupted by four equally-spaced radially-projecting flanges integrally joined to the elongated cylinder of the vertical support member, at the outer contour of the elongated cylinder, at substantially 90 degree intervals about the circumference of the elongated cylinder, the vertical support member being capable of joining end-to-end to a second vertical support member, one above the other, by means of one or more structural end joint members, wherein the elongated hollow cylinder has a length and a diameter, wherein said length is significantly longer than said diameter, and wherein the flanges extend substantially the entirety of said length, wherein the barrier net is comprised of a border rope that supports a heavy debris liner comprised of strands, twine or rope approximately 3/16 inch diameter spaced approximately 4 to 6 inches center to center, a fine liner comprised of strands, twine or rope approximately ½ the diameter of the heavy debris liner spaced approximately ¼ inch center to center and an approximately 1 inch diameter heavy duty strap placed approximately every foot horizontally, thereby forming a triple layer safety net to stop construction debris from blowing off said higher or adjacent levels of a building during construction operations.

12. The safety barrier system of claim 11, wherein the height between a first floor, deck or slab of a building under construction or maintenance and a superimposed second floor, deck or slab one floor higher has a predetermined value, said vertical support members are extendable to or beyond said predetermined height of the superimposed second floor, deck or slab and said vertical support members are capable of being extended upwardly a sufficient distance to enable said safety barrier net to be elevated, in positioned relation between the vertical support members, and extending above said superimposed second floor, deck or slab, to constitute an effective safety barrier above, below, and at the level of said superimposed second floor, deck or slab.

13. The safety barrier system of claim 11 further comprised of multiple elongated safety barrier nets and wherein said nets and support structure comprise a safety barrier substantially enclosing either the perimeter of the top of a multi-story building or an area of a building under construction or maintenance.

14. The safety barrier system of claim 11, wherein said vertical support member is slidably engaged with the bracket structure via roller wheels which engage a flange of the vertical support member.

15. The safety barrier system of claim 11, further including bracing or support members situated between said vertical support member and substantially parallel to the plane of the exterior face of the building under construction or maintenance.

16. The safety barrier system of claim 11, further including members comprising toe boards or barriers laterally coextensive with said safety barrier net being of restricted depth sufficient to bridge a gap between the safety net and the adjacent edge of said building floor, deck or slab.

17. The safety barrier system of claim 11, wherein said heavy debris liner is comprised of a coarse mesh for preventing the passage of workers or large heavy articles of debris and said fine liner is comprised of a fine mesh for preventing the passage of smaller articles of debris, said fine mesh portion of said barrier net being releasably attached on at least one side or edge of said barrier net so that said side or edge of said barrier net detaches at a predetermined wind or weight loading.

18. The safety barrier system of claim 11 wherein said bracket structure is comprised of at least two separate bracket members situated at two different floors, decks or slabs immediately adjacent each other so as to guide the vertical support member during vertical repositioning of said safety barrier system and to hold the vertical support member in position during building construction or maintenance.

19. The safety barrier system of claim 11, wherein said bracket structure is comprised of a releasable scissor mechanism which facilitates the capability of releasable slidable engagement of the bracket to a vertical support member, said releasable slidable engagement capability being provided by allowing the bracket to be opened substantially horizontally in opposing directions on either side of a vertical support member.

20. The safety barrier system of claim 11 wherein the flanges have a plurality of holes that are spaced along the axial length of the flanges for attaching one or both of (a) netting to form a safety barrier system and (b) structural braces or girts to enhance the rigidity of the safety barrier system.

21. The safety barrier system of claim 11, wherein a truss system is attached to the outwardly facing side of at least one vertical support member to enhance the structural rigidity of the safety barrier system.

22. The safety netting system of claim 11, wherein the vertical support member and flanges are manufactured as an integral unit by extrusion.

* * * * *